US005585598A

United States Patent [19]

Kasahara et al.

[11] Patent Number: 5,585,598

[45] Date of Patent: Dec. 17, 1996

[54] ROTARY DEVELOPING DEVICE FOR AN IMAGE FORMING APPARATUS

[75] Inventors: Nobuo Kasahara, Yokohama; Toshiya Sato, Gotenba, both of Japan

[73] Assignee: Ricoh Company, Ltd., Tokyo, Japan

[21] Appl. No.: 401,699

[22] Filed: Mar. 10, 1995

[30] Foreign Application Priority Data

Mar. 11, 1994 [JP] Japan ..... 6-041305
Mar. 24, 1994 [JP] Japan ..... 6-077956

[51] Int. Cl.[6] ..... G03G 15/01; G03G 15/08

[52] U.S. Cl. ..... 118/645; 355/245; 355/326 R

[58] Field of Search ..... 355/200, 245, 355/326 R; 118/645

[56] References Cited

U.S. PATENT DOCUMENTS 3,987,756 10/1976 Katayama et al. ..... 355/245
4,713,673 12/1987 Kessoku ..... 118/645
4,792,825 12/1988 Saito et al. ..... 355/326 R
4,922,301 5/1990 Katoh et al. ..... 118/645
5,331,390 7/1994 Kimura et al. ..... 355/326 R

FOREIGN PATENT DOCUMENTS 63-7817 4/1988 Japan .
385564 4/1991 Japan .
4119376 4/1992 Japan .

*Primary Examiner*—Joan H. Pendegrass
*Assistant Examiner*—Sophia S. Chen
*Attorney, Agent, or Firm*—Oblon, Spivak, McClelland, Maier & Neustadt, P.C.

[57] ABSTRACT

In an image forming apparatus, a rotary developing device has a rotary developing unit or revolver facing a photoconductive element. The revolver rotatably supported by a pair of pivotable arms which are constantly biased toward the photoconductive element. When the revolver is rotated to bring one of developing sections thereof to a developing position, a developing roller built in the developing section is accurately positioned relative to the photoconductive element.

9 Claims, 16 Drawing Sheets

ROTARY DEVELOPING DEVICE FOR AN IMAGE FORMING APPARATUS

BACKGROUND OF THE INVENTION

The present invention relates to a color copier, color printer, color facsimile apparatus or similar multicolor image forming apparatus and, more particularly, to a rotary developing device included in such an image forming apparatus.

Generally, a rotary developing device has a developing unit or revolver accommodating a plurality of developing sections therein. The developing sections are arranged around a rotary shaft on which the revolver is mounted. The revolver is rotated to bring one of the developing sections to a developing position facing an image carrier which carries an electrostatic latent image thereon. The developing section arrived at the developing position develops the latent image with a developer carrier on which a developer is deposited. This type of developing devices are disclosed in, for example, Japanese Patent Laid-Open Publication Nos. 63-78169 through 63-78175, 63-177165, 63-178262, 63-178263, 3-68973, 3-68970, 3-111868, 3-264967, 4-78873, 4-78875, 4-348368, 4-8790, 61-243467, 4-78872, 4-78884, 4-78876, 57-111555, and 64-40957 as well as in Japanese Patent Publication Nos. 64-8330 and 4-10071 and U.S. Pat. No. 5,168,319.

To produce an image of desirable quality with the rotary developing device, the developer carrier brought to the developing station must be accurately positioned relative to the surface of the image carrier. Also, a predetermined gap for development must be formed between the image carrier and the developer carrier. Further, vibration must be suppressed when the revolver is driven. The conventional developing devices taught in the above-mentioned documents cannot meet such requirements and, moreover, increase the cost due to complicated constructions.

Japanese Laid-Open Publication Nos. 57-111555 and 64-40957 mentioned above propose arrangements for applying a bias voltage to the developer carrier implemented as a roller. However, such arrangements are also extremely complicated.

SUMMARY OF THE INVENTION

It is, therefore, an object of the present invention to provide a rotary developing device for an image forming apparatus and capable of forming a predetermined gap between an image carrier and a developer carrier included in each developing section of a revolver.

It is another object of the present invention to provide a rotary developing device for an image forming apparatus and capable of applying bias voltages to each developing section of a revolver with a simple construction.

In accordance with the present invention, a rotary developing device for an image forming apparatus and for developing a latent image electrostatically formed on an image carrier has a revolver having at least two developing sections each storing a developer of particular color, and each having a developer carrier for conveying the developer deposited thereon, and a revolver drive source for rotating the revolver such that one of the developing sections is brought to a developing position facing the image carrier at a time. The revolver has a pivotable support for supporting the revolver such that the revolver is movable toward or away from the image carrier, and a biasing device for constantly biasing the revolver toward the image carrier.

BRIEF DESCRIPTION OF THE DRAWINGS

The above and other objects, features and advantages of the present invention will become apparent from the following detailed description taken with the accompanying drawings in which.

DESCRIPTION OF THE PREFERRED EMBODIMENT

Figure 1:
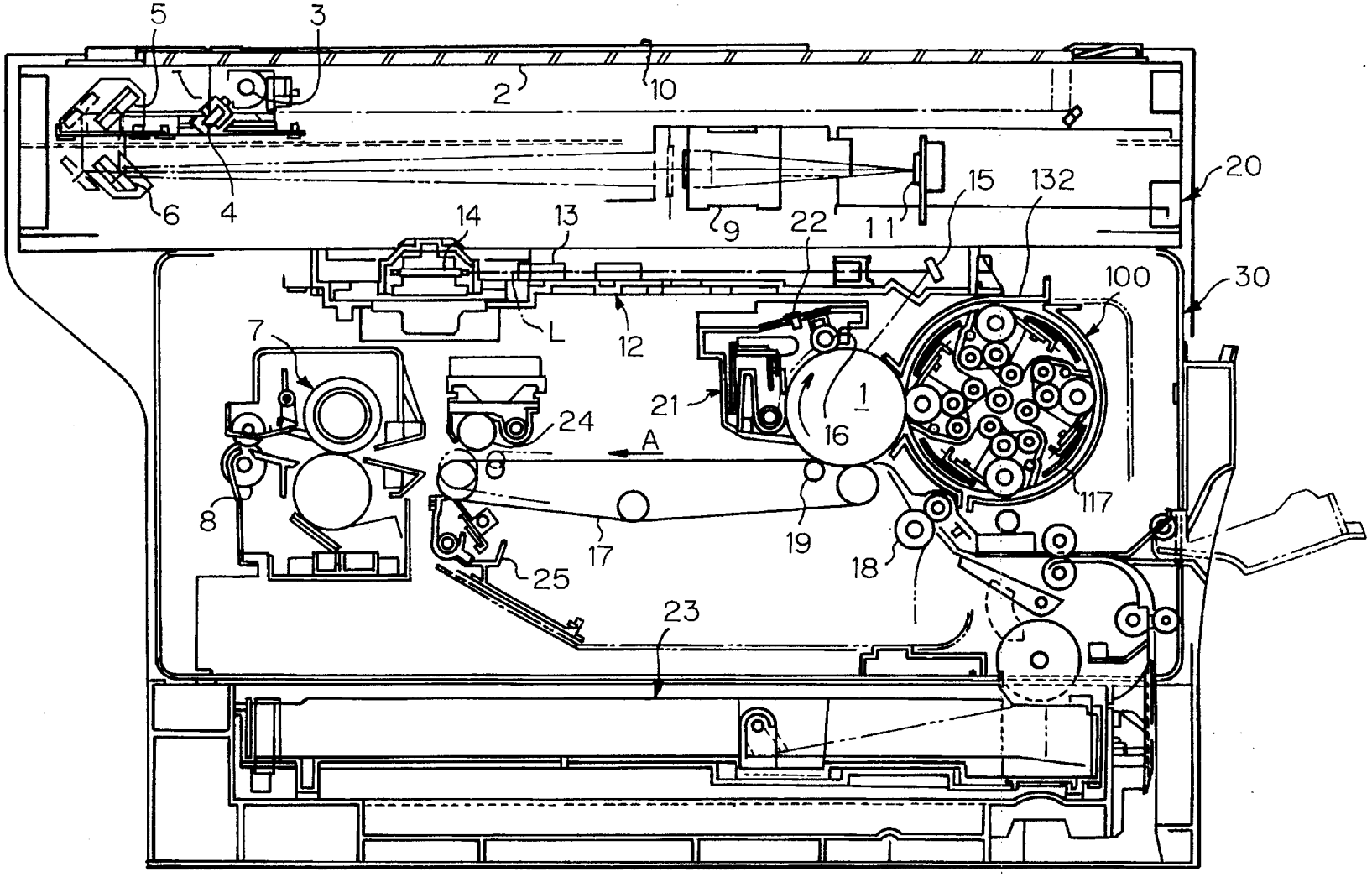
FIG. 1 is a section of a full-color copier including a rotary developing device embodying the present invention.

Referring to FIG. 1 of the drawings, a full-color copier having a rotary developing device embodying the present invention is shown. As shown, the copier is generally made up of an image reading section 20 and an image recording section 30 disposed below the section 20. A document 10 is laid on a glass platen 2 mounted on the top of the casing of the image reading section 20. A cover plate, not shown, presses the document 10 from above.

A scanner is disposed in the casing of the image reading section 20 and made up of a lamp 3, a first to a third mirror 4, 5 and 6, and a lens 9. On the start of an image forming operation, the lamp 3 and mirrors 4–6 are moved to the right as viewed in FIG. 1, while illuminating the document 10. The resulting reflection from the document 10 is routed through the mirrors 4–6 and lens 9 and incident to a CCD (Charge Coupled Device) or similar color sensor 11. Such an image reading operation is repeated a plurality of times to read a blue component, green component, and red component out of the document 10. These color components are each convened to a corresponding electric signal. An image processing section processes the electric color image signals on the basis of their intensity levels, thereby producing yellow, magenta, cyan and black color image data.

An optical writing unit 12 is included in the image recording section 30 and has a laser 13. The laser 13 emits a beam L modulated by each of the color image data. The beam L is reflected by a polygonal mirror 14 which is in rotation. The beam L from the polygonal mirror 14 is passed through predetermined optical elements and then reflected by a mirror 15. The beam L from the mirror 15 scans the surface of a photoconductive drum 1 which is a specific form of an image carrier.

The drum 1 is rotatably mounted on the body of the copier (body of the image recording section 30 in the embodiment) and rotated clockwise, as viewed in the figure, by a driving device, not shown. A charge roller 16, playing the role of a main charger, uniformly charges the surface of the drum 1 being rotated. The beam L illuminates the charged surface of the drum 1 so as to electrostatically form a latent image thereon.

The latent image is formed by each of the yellow, magenta, cyan and black color image data. Pot example, a latent image based on the yellow image data (yellow latent image hereinafter) is formed on the drum 1 and then developed by yellow toner by a rotary developing device 100 which will be described. The resulting yellow toner image is transferred from the drum 1 to an intermediate transfer belt 17 by a transfer roller or transfer device 19. After the image transfer, the toner remaining on the drum 1 is removed by a cleaning device 21. Subsequently, a charge pattern remaining on the surface of the drum 1 is dissipated by a discharge lamp or discharging device 22.

A latent image based on the magenta image data (magenta latent image) is formed on the drum 1 in the same manner as the yellow latent image. The magenta latent image is developed by the developing device 100 to turn out a magenta toner image. The magenta toner image is transferred to the intermediate transfer belt 17 in register with the yellow toner image existing on the belt 17. The cleaning device 21 and discharge lamp 22 again clean up the surface of the drum 1. Likewise, a latent image based on the cyan image data (cyan latent image) is formed on the drum 1, developed by the developing device 100 to turn out a cyan toner image, and then transferred to the belt 17 in register with composite toner image existing on the belt 17. After the surface of the drum 1 has been cleaned up by the cleaning device 21 and discharge lamp 22, a latent image based on the black image data (black latent image) is formed on the drum 1, developed by the developing device 100 to turn out a black toner image, and then transferred to the belt 17 in register with the composite toner image existing on the belt 17. As a result, a full-color image is completed on the belt 17. After the transfer of the black toner image, the cleaning device 21 and discharge lamp 22 again clean up the surface of the drum 1.

A paper, not shown, is fed from a paper feed section 23 toward a registration roller pair 18. The registration roller pair 18 once stops the paper and then drives it toward the intermediate transfer belt 17 at a predetermined timing. The paper is laid on the full-color image formed on the belt 17 and conveyed by the belt 17 in a direction indicated by an arrow A in the figure. The transfer roller 24 transfers the toner image from the belt 17 to the paper. The paper carrying the toner image thereon is separated from the belt 17. When the paper is passed through a fixing device 7, the toner image is fixed on the paper. Finally, the paper, or full-color copy, is driven out of the copier by an outlet roller pair 8.

After the transfer of the toner image to the paper, the belt 17 is cleaned and prepared for the next image forming operation by a cleaning device 25.

In a black-and-white copy mode, a latent image formed on the drum 1 is developed by the developing device 100 to turn out a black toner image. The black toner image is directly transferred to a paper fed from the paper feed section 23 and then fixed by the fixing unit 7.

Figure 2:
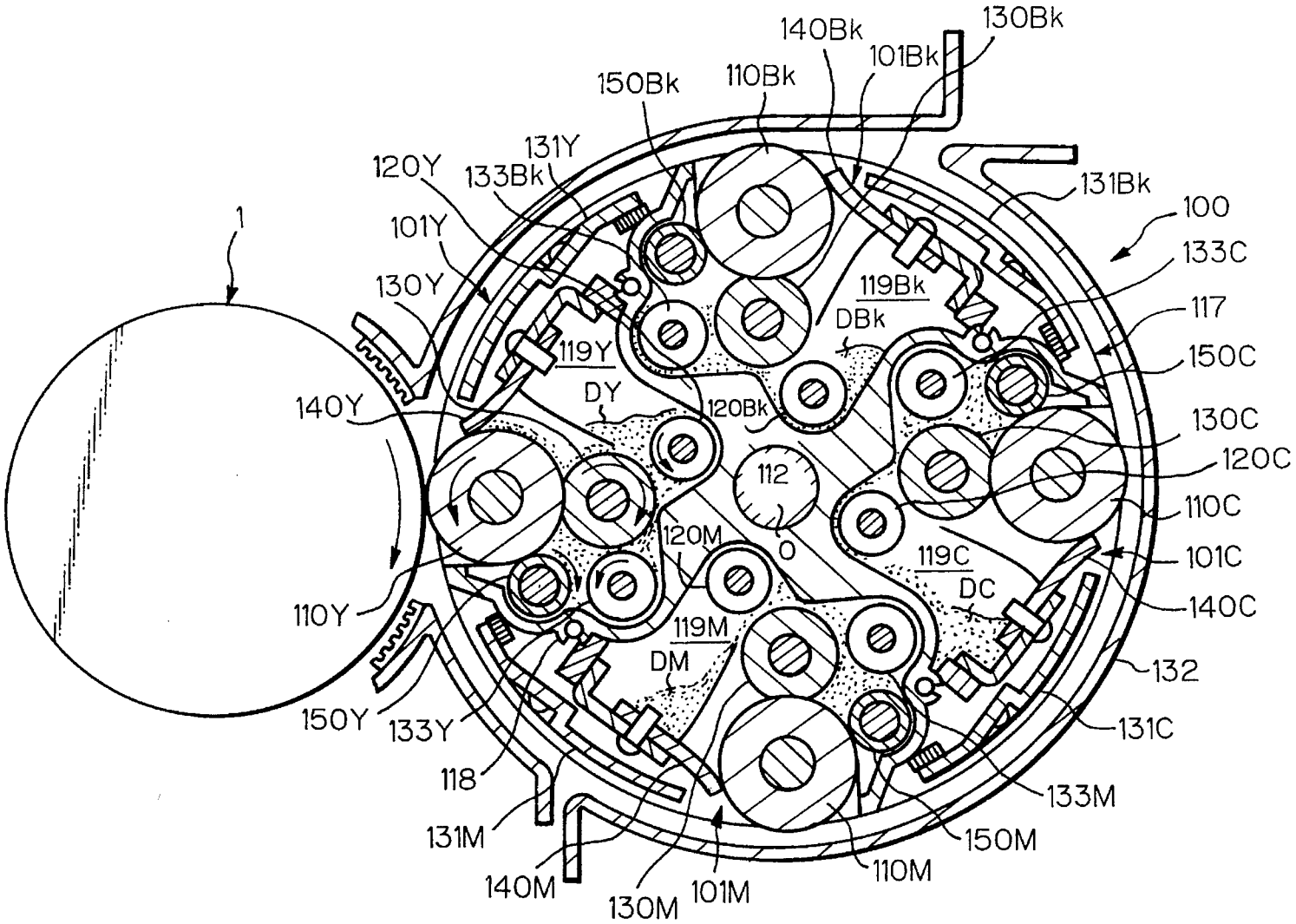
FIG. 2 is an enlarged section of the developing device.
Figure 3:
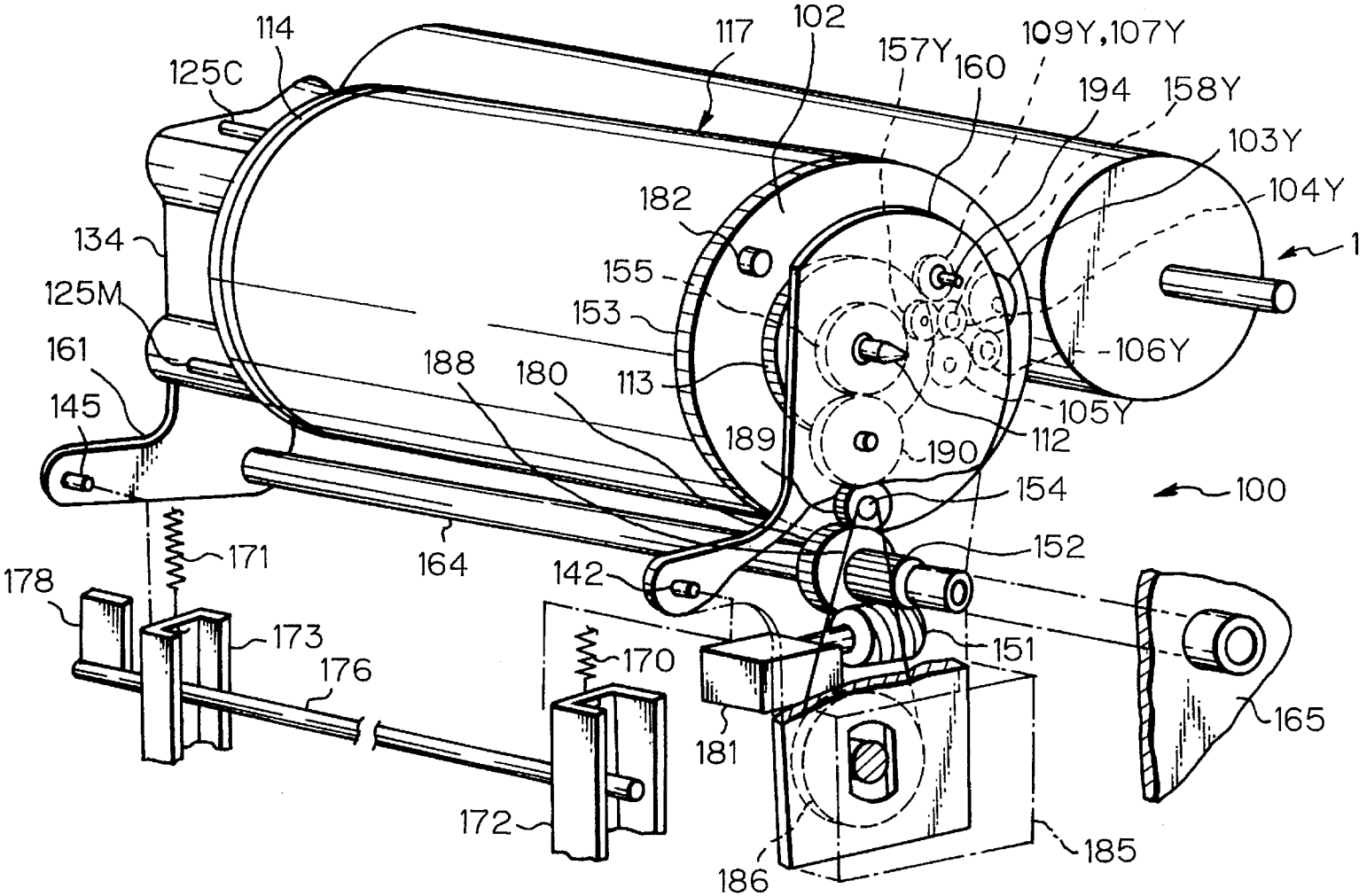
FIG. 3 is an external view of the developing device as seen obliquely from the rear.

The rotary developing device 100 will be described in detail with reference to FIGS. 2 and 3. FIG. 2 is an enlarged section of the developing device 100 while FIG. 3 is an external view as viewed obliquely from the rear of the copier. FIG. 1 shows the copier in a front view. It is to be noted that the words "front" and "rear" to repeatedly appear hereinafter are used in this sense.

As shown in FIGS. 1–3, the developing device 100 has a rotary developing unit or revolver 117 generally implemented as a hollow cylinder parallel to the drum 1. A plurality of (four in the embodiment) developing sections 101Y (yellow), 101M (magenta), 101C (cyan) and 101 Bk (black) are arranged in the revolver 117. The revolver 117 is mounted on a rotary shaft 112 and has a casing 118, and a rear end wall 102 and a front end wall 114 each having a disk-like configuration. The casing 118 extends in the axial direction of the revolver 117. The end walls 114 and 102 are respectively affixed to the front and rear ends of the casing 118. Such constituent parts form compartments 119Y, 119M, 119C and 119Bk in the developing sections 101Y, 101M, 101C, and 101Bk, respectively. As shown in FIG. 2, lid members 131Y, 131M, 131C and 131Bk are affixed to the casing 118 and respectively close openings formed in the compartments 119Y–119Bk.

In FIG. 3, the configuration of the outer periphery of the revolver 117 is not shown specifically, While FIGS. 1 and 2 show a cover 132 affixed to the copier body, the other figures do not show it for clarity.

The developing section 101Y develops the yellow latent image formed on the drum 1. Likewise, the developing sections 101M, 101C and 101Bk respectively develop the magenta, cyan and black latent images sequentially formed on the drum 1. The developing sections 101Y–101Bk will be respectively referred to as a yellow, a magenta, a cyan and a black developing section, as the case may be As shown in FIG. 2, The developing section 101Y stores a yellow developer DY in the compartment 119Y. Likewise, the developing sections 101M, 101C and 101Bk respectively store a magenta developer DM, a cyan developer DC and a black developer DBk in their compartments 119M, 119C and 119Bk. While the developers DY–DBk may each be implemented as a toner and carrier mixture, the embodiment uses nonmagnetic developers not containing carrier therein. Use may be made of magnetic developers not containing carrier, if desired. Further, while the revolver 117 is shown as having four compartments, the present invention is practicable only if the revolver 117 has at least two compartments, each storing a developer of particular color.

The revolver 117 is rotated about an axis O, FIG. 2, by a revolver drive means which will be described. As a result, one of the developing sections 101Y–101Bk is brought to a developing position where it faces the drum 1. FIGS. 2 and 3 show a specific condition wherein the yellow developing section 101Y is located at the developing position.

As shown in FIG. 2, the yellow developing section 101Y has a developing roller 110Y which is a specific form of a developer carrier, a developer supply roller 130Y, a roller 150Y for removing a residual image, a screw 120 Y for sending out the developer, and a screw 133Y for sending in the developer. These developing elements are journalled to the opposite end walls 102 and 114 of the revolver 117 and rotated by a developing section drive motor, which will be described, as indicated by arrows in the figure.

As shown in FIG. 2, to develop the yellow latent image on the drum 1, the developer supply roller 130Y is rotated clockwise, as viewed in the figure, to supply the yellow toner DY to the developing roller 110Y. As a result, the yellow toner DY is deposited on the developing roller 110Y which is rotating counterclockwise as viewed in the figure. A doctor blade 140Y is affixed to the casing 118 at one end thereof. While the toner DY is conveyed by the developing roller 110Y, it is leveled and charged by the doctor blade 140Y. On reaching the developing position, the toner DY is electrostatically transferred from the developing roller 110Y to the yellow latent image formed on the drum 1 which is rotating clockwise. Consequently, the toner DY develops the latent image to produce a yellow toner image.

In the illustrative embodiment, the developing roller 110Y has a core or shaft made of metal or similar rigid material, and a rubber or similar elastic layer covering the surface of the core. The roller 110Y is pressed against the drum 1 to implement so-called contact development. The surface of the roller 110Y is elastically deformed by, for example, about 0 mm to 0.5±0.01 mm due to the reaction of the drum 1.

The toner DY remaining on part of the roller 110Y moved away from the developing position is leveled by the residual image removing roller 150Y. This roller 150Y rotates clockwise, as viewed in FIG. 2, in contact with the roller 110Y. Consequently, the amount of toner DY on the roller 110Y becomes uniform. In addition, the roller 150Y dissipates the charge or the toner DY remaining on the roller 110Y.

The screw 120Y, rotating counterclockwise in FIG. 2, conveys the toner DY to the outside of the compartment 119Y. The screw conveyor 133Y, also rotating counterclockwise in FIG. 2, returns the toner DY into the compartment 119Y. By so conveying the toner DY in the axial direction of the roller 110Y, it is possible to uniformly distribute it in the axial or longitudinal direction of the roller 110Y. Hence, the toner DY is supplied to the roller 110Y in a uniform amount, so that the resulting image on the drum 1 is free from irregularities in density.

The other developing sections 101M, 101C and 101Bk are identical in construction with the developing section 101Y. The revolver 117 is rotated clockwise, as viewed in FIG. 2, about the axis O to sequentially bring the developing sections 101M–101Bk to the developing position. Hence, the developing sections 101M–101Bk sequentially develop the magenta, cyan and black latent images in exactly the same manner as the developing section 101Y develops the yellow latent image. Let the constituent parts of the developing sections 101M–101Bk be simply distinguished from those of the developing section 101Y by suffixes M, C and Bk.

Figure 6:
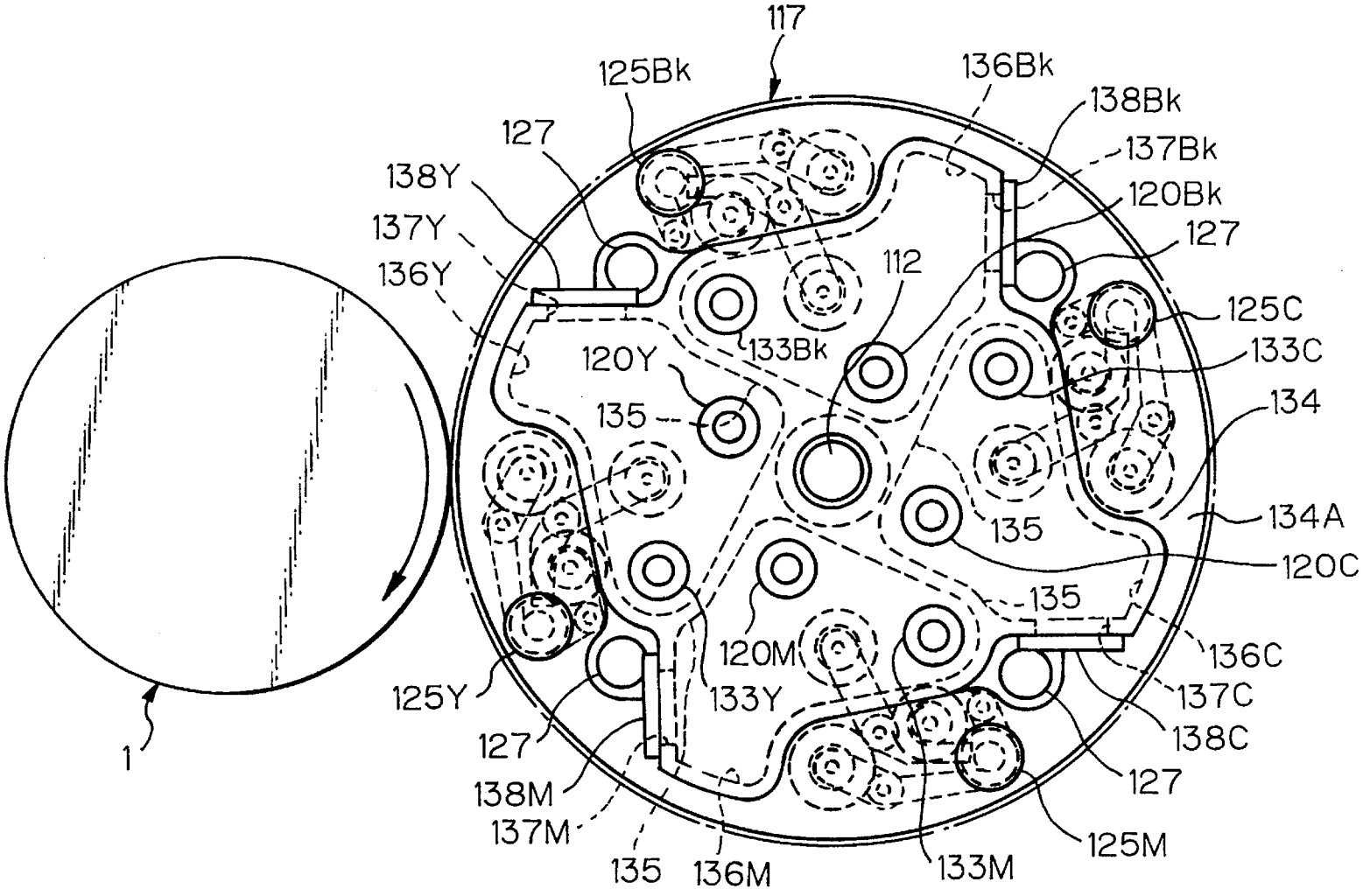
FIG. 6 shows a rotary developing unit or revolver included in the developing device.

As shown in FIGS. 3. 5 and 6, a developer container, or toner container in the embodiment, 134 is fastened to the front end wall 114 of the revolver 117 by screws 127 (see FIG. 6). The interior of the toner container 134 is partitioned by walls 135 to form spaces 136Y, 136M, 136C and 136Bk corresponding to the compartments 119Y, 119M, 119C and 119Bk, respectively. The screws 120Y–120Bk disposed in the respective compartments send out the toner of different colors to the corresponding spaces 136Y–136Bk. The screws 133Y–133Bk respectively return the toner from the spaces 136Y–136Bk to the corresponding compartments 119Y–119Bk.

The walls of the toner container 134 defining the spaces 136Y–136Bk are respectively formed with openings 137Y–137Bk for replenishing fresh toner. Usually, these openings are respectively closed by removable caps 138Y–138Bk. The caps 138Y–138Bk may each be removed in order to replenish toner into the associated space 136Y–136Bk.

Now, to enhance the quality of toner images to be formed by the developing sections 101Y–101Bk, i.e., the quality of a full-color image to be formed on a paper, it is necessary that the developing rollers 110Y–110Bk be each accurately positioned relative to the drum 1, as stated earlier. Specifically, when use is made of contact development, as in the embodiment, the developing roller brought to the developing position must be pressed against the drum 1 by a uniform pressure over the entire axis thereof.

As shown in FIGS. 3, 4, 5, 7 and 8, the embodiment meets the above requirement by using a pair of pivotable bodies implemented as parallel arms 160 and 161. The axially opposite ends of the revolver 117 are rotatably supported by the arms 160 and 161. Specifically, the rear end of the shaft 112, on which the revolver 117 is mounted, is rotatably supported by the rear arm 160 via a bearing 162. Likewise, the front end of the shaft 112 is rotatably supported by the front arm 161 via a bearing 163 (see FIG. 5). The arms 160 and 161, facing each other, are pivotably mounted on a support shaft 164 via bearings. The support shaft 164 extends in parallel to the shaft 112 of the revolver 117 and is affixed to a rear side wall 165 and a front side wall 166 forming part of the copier body. In this configuration, the arms 160 and 161 are pivotable relative to the copier body. In FIG. 3, only part of the rear side wall 165 is shown in a position spaced apart from the revolver 117, and the front side wall 166 is not shown. Further, in FIG. 3, the rear arm 160 is partly taken away.

As stated above, the revolver 117 is supported by the arms 160 and 161 in such a manner as to be movable toward and away from the drum 1 while remaining parallel to the drum 1. The arms 160 and 161, therefore, constitute a specific pivotable support means supporting the revolver in such a condition. A retainer ring 179 (see FIG. 8) prevents the front arm 161 from slipping out of the shaft 164. The retainer ring 179 may be removed to remove the front arm 161 from the shaft 164. The arms 160 and 161 may be formed integrally with each other, if desired.

Figure 7:
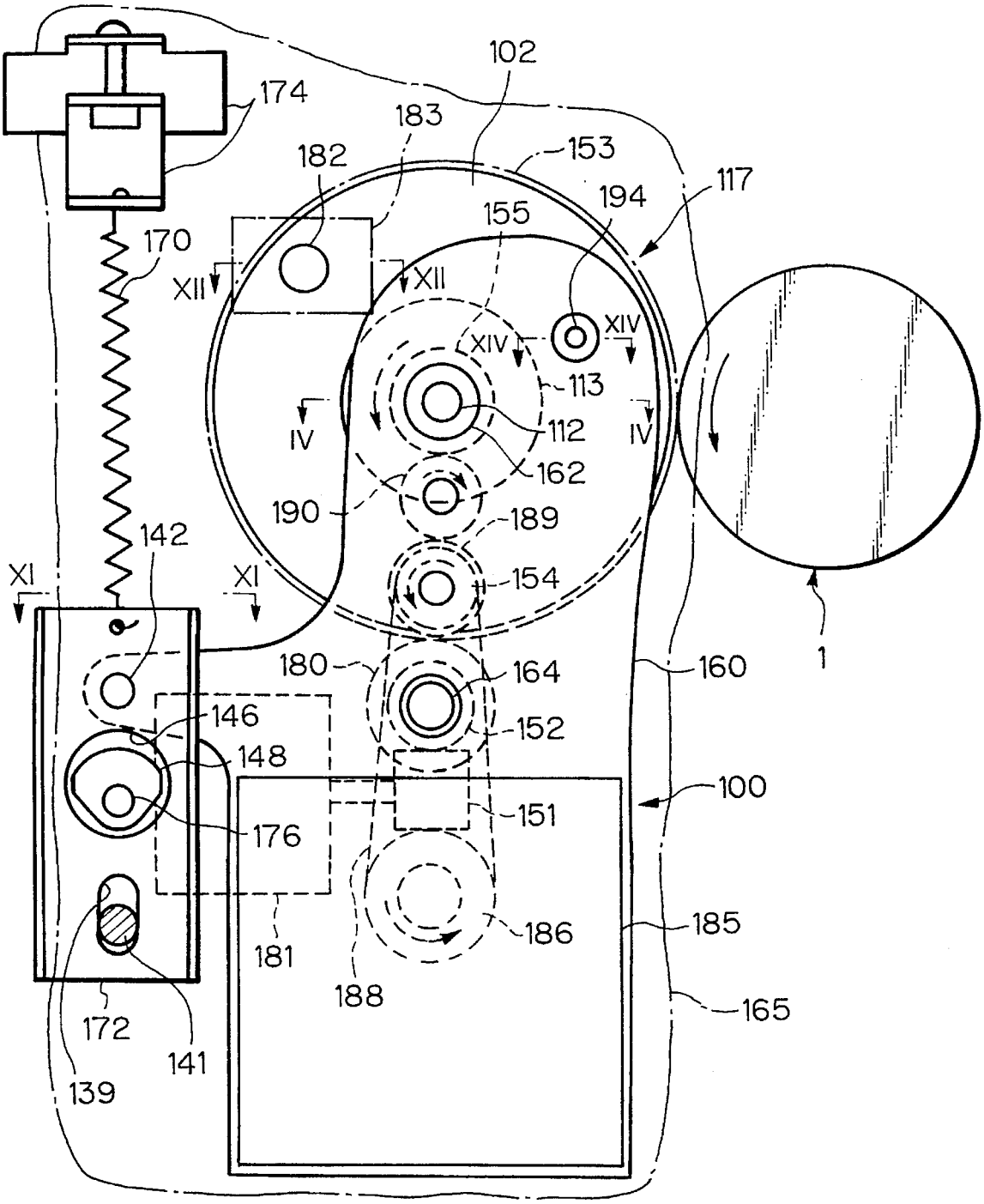
FIG. 7 is an elevation of the developing device as seen from the rear.
Figure 8:
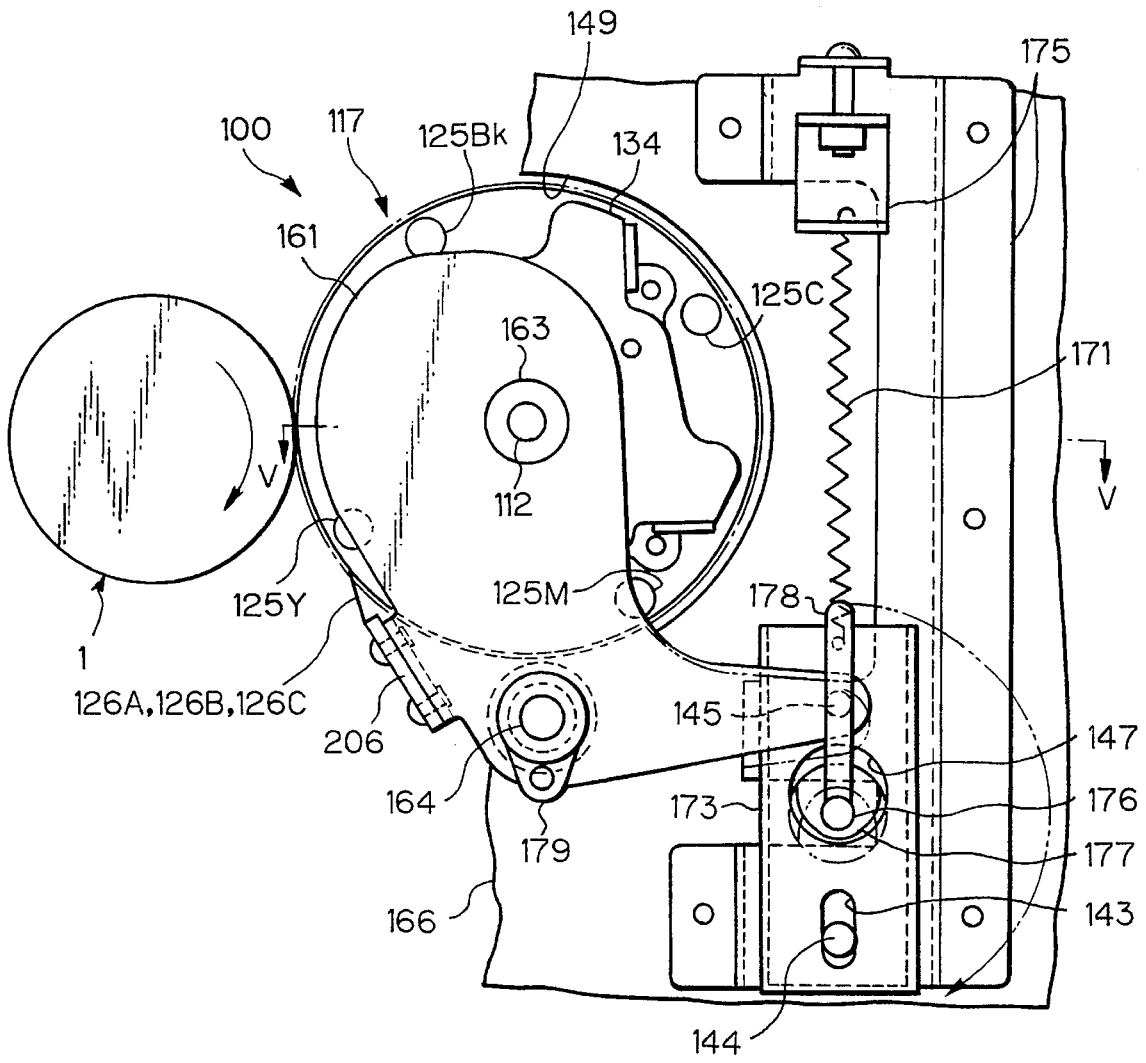
FIG. 8 is a view of the developing device as seen from the front.

As shown in FIGS. 3, 7 and 8, tension springs 170 and 171 respectively constantly bias the arms 160 and 161 such that the ends of the arms 160 and 161 tend to approach the drum 1. The revolver 117, therefore, has one of the developing rollers thereof pressed against the drum 1 at the developing position. For example, when the yellow developing section 101Y is brought to the developing position, the developing roller 110Y is pressed against the drum 1. The tension springs 170 and 171 constitute a specific means for biasing the revolver 117 toward the drum or image carrier 1. How the tension springs 170 and 171 are anchored to the arms 160 and 161 will be described in detail later.

In the specific condition shown in FIG. 2, the developing roller 110Y is accurately positioned relative to the drum 1 over the entire length thereof. Specifically, the elastic material covering the core of the roller 110Y is uniformly pressed against the drum 1 and uniformly deformed thereby. This successfully protects toner images formed on the drum 1 from irregularities in density and, therefore, provides them with superior quality. Further, in the embodiment, the arms 160 and 161 rotatably support the opposite ends of the revolver 117 and are constantly biased by the tension springs 170 and 171, respectively. As a result, forces of the same magnitude act on opposite ends of the roller 110Y, effectively pressing the roller 110Y against the drum 1 with a uniform pressure.

Figure 9:
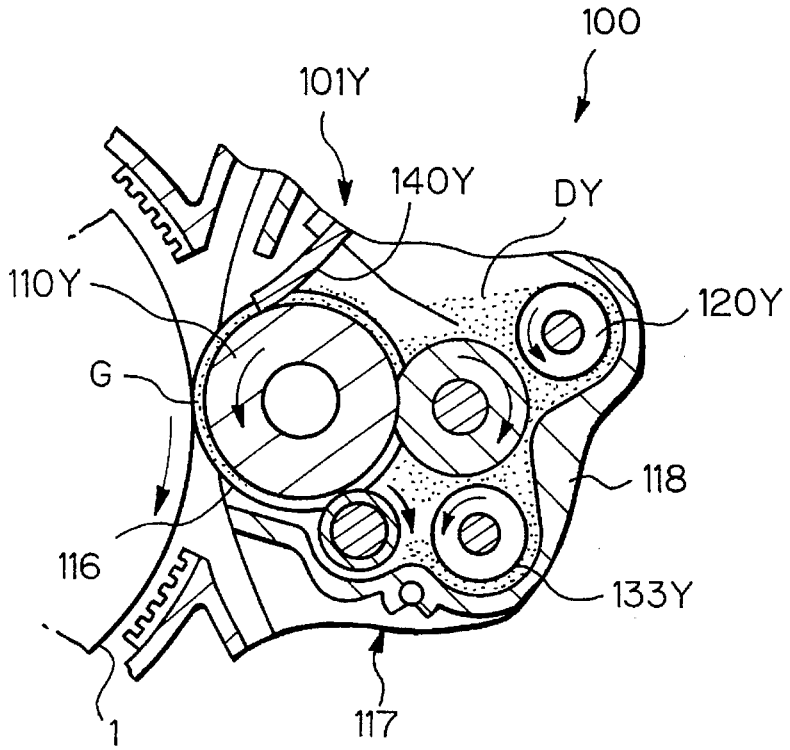
FIG. 9 is a fragmentary section of a non-contact type developing device as seen from the front.
Figure 10:
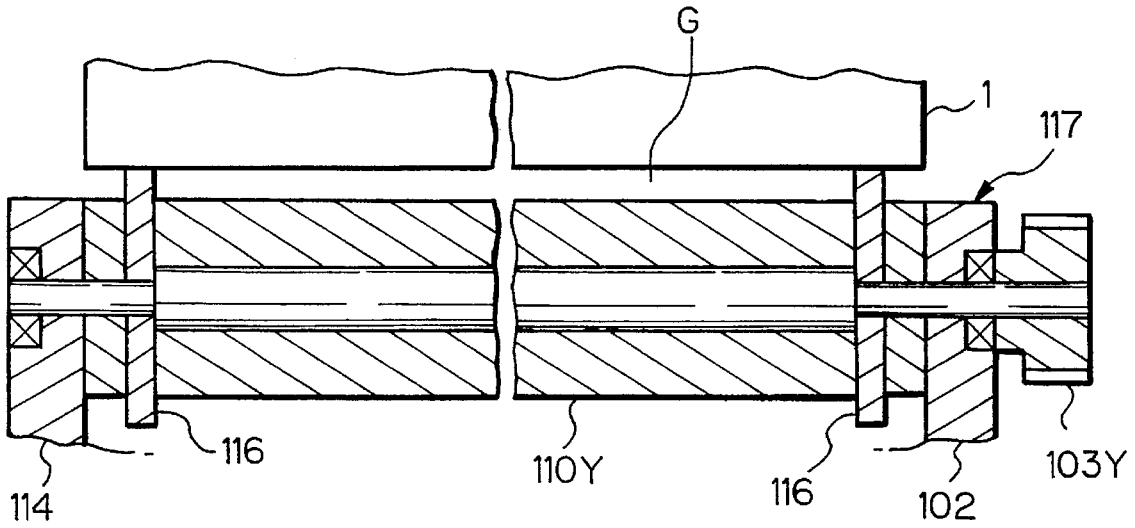
FIG. 10 shows a positional relation between a developing roller of the developing device and a photoconductive element.

Assume that non-contact development is effected, i.e., development is effected without the developing roller contacting the drum 1 at the developing position. Then, as shown in FIGS. 9 and 10, spacer rollers 116 may be mounted on opposite ends of the shaft of the developing roller 110Y coaxially with the shaft. In this case, such spacer rollers 116 will also be mounted on the other developing rollers 110M, 110C and 110Bk, although not shown in FIGS. 9 and 10. When the roller 110Y, for example, is brought to the developing position, the spacer rollers 116 thereof contact the end portions of the drum 1. The spacer rollers 116 are pressed against the drum 1 by a uniform pressure because the revolver 117 is movable toward and away from the drum 1 and constantly biased toward the drum 1 by the springs 170 and 171, FIG. 3. The gap G between the drum 1 and the roller 110Y is maintained constant in the axial direction of the drum 1. In this condition, the latent image on the drum 1 can be developed by the toner flying away from the roller 110Y, thereby producing a toner image of desirable quality. The spacer rollers 116 may be replaced with any other suitable spacers, if desired. The advantage described above is achievable without regard to the kind of the developer, i.e., whether it be a toner and carrier mixture or magnetic toner. For non-contact development, the surface of the developing roller may be formed of an elastic material or a rigid material.

Figure 11:
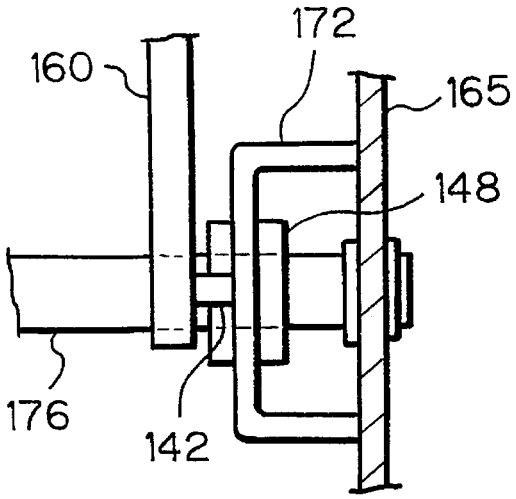
FIG. 11 is a section along line XI—XI of FIG. 7.

While the tension springs 170 and 171 may be directly anchored to the arms 160 and 161 and copier body at opposite ends thereof, the illustrative embodiment anchors them to the arms 160 and 161 in the following unique configuration. As shown in FIGS. 7 and 11, a slider 172 adjoins the rear side wall 165 of the copier body. A guide slot 139 extends in the vertical direction of the slider 172. A guide pin 141 is studded on the rear side wall 165 and slidably received in the guide slot 139. A rear tension spring 170 is anchored to the upper end of the slider 172 at one end. The other end of the tension spring 170 is anchored to a bracket 174 affixed to the side wall 165. The rear arm 160 is pivotably connected to the slider 172 by a pin 142. In FIG. 7, the side wall 165 is indicated by a phantom line.

Figure 5:
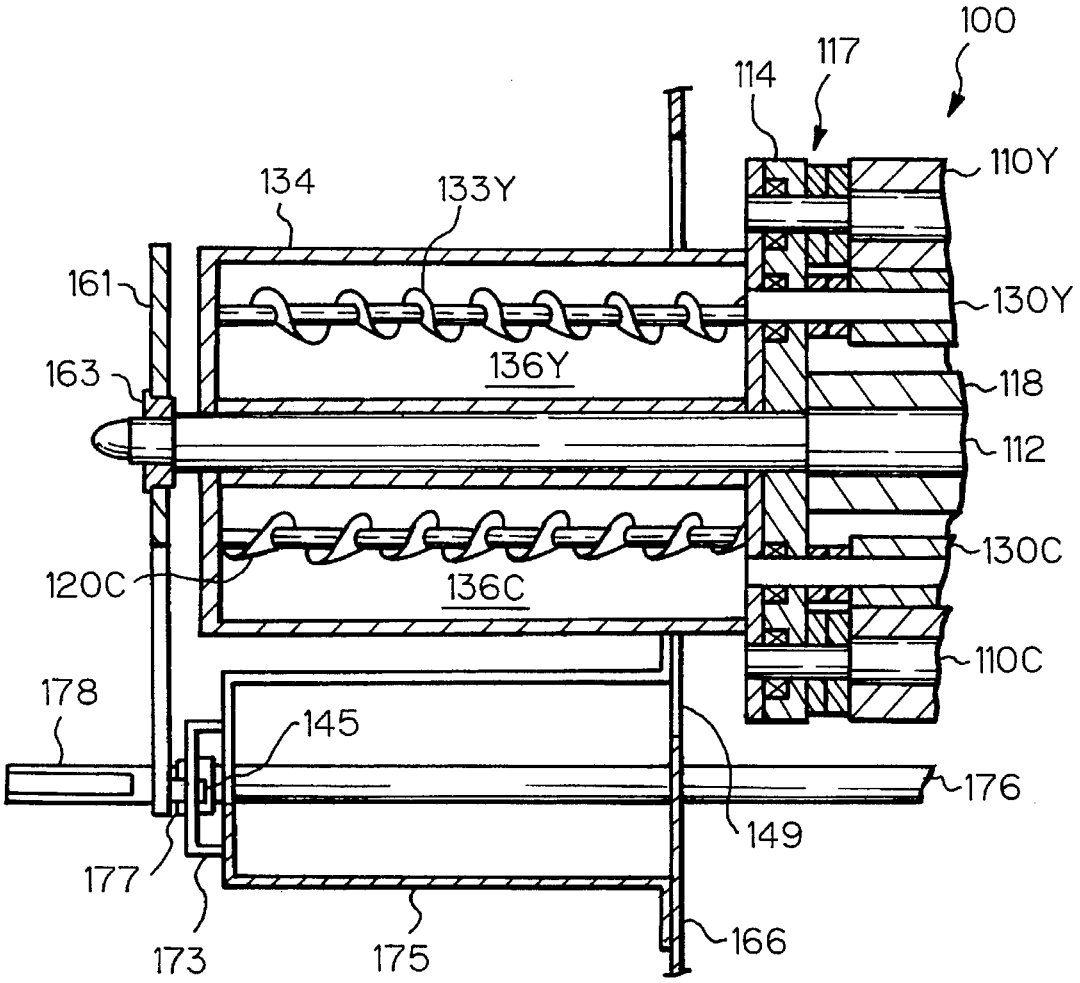
FIG. 5 is a section along line V—V of FIG. 8.

On the other hand, as shown in FIGS. 5 and 8, a vertically extending bracket 175 is affixed to the front side wall 166 of the copier body. A front slider 173 adjoins the bracket 175. An elongated guide slot 143 extends vertically in the slider 173. A guide pin 144 is studded on the bracket 175 and slidably received in the guide slot 143. In this condition, the slider 173 is movable up and down relative to the bracket 175. A front tension spring 171 is anchored to the upper end of the slider 173 at one end and to the lower end of the bracket 175 at the other end. The front arm 161 is pivotably connected to the slider 173 by a pin 145.

As shown in FIGS. 7 and 8, through holes 146 and 147 are formed in the rear slider 172 and the front slider 173, respectively. A press shaft 176 extends through the holes 146 and 147 (see FIG. 3 also). Cams 148 and 177 are respectively mounted on the portions of the press shaft 176 received in the holes 146 and 147. An operating lever 178 is affixed to the front end of the press shaft 176. The press shaft 176 extends in parallel to the drum 1 and revolver 117 and is rotatably, but not axially displaceably, supported by the side walls 165 166. Usually, the cams 148 and 177 remain clear of the edges of the holes 146 and 147. In this condition, the sliders 172 and 173 are respectively biased upward by the tension swings 170 and 171 without being restricted by the cams 148 and 177. Therefore, the arms 160 and 161 pivotably connected to the sliders 172 and 173, respectively, are biased such that their upper ends approach the drum 1, so that the developing roller located at the developing position is pressed against the drum 1.

When the operating lever 178 is turned 180 degrees from the position shown in FIG. 8 in a direction indicated by a phantom line, the press shaft 176 is rotated about its own axis and causes the cams 148 and 177 mounted thereon to urge the edges of the holes 146 and 147 downward (phantom line position in FIG. 8). As a result, the sliders 172 and 173 are lowered and cause the arms 160 and 161 to pivot about the support shaft 164 against the action of the tension springs 170 and 171, as indicated by a phantom line in FIG. 8. Consequently, the revolver 117 and, therefore, the developing roller is moved away from the drum 1. In this condition, the retainer ring 179, FIG. 8, may be removed from the shaft 164, and then the arm 161 may be pulled to the front away from the shaft 164 and revolver 117. Then, the revolver 117 can be pulled out to the front through an opening 149 (see FIGS. 5 and 8) formed in the front side wall 166. At this instant, the surface of the drum 1 is protected from scratches because the developing roller has been spaced apart from the drum 1. To mount the revolver 117 to the copier body, a procedure opposite to the above procedure is performed. Then, the operating lever 178 is turned 180 degrees to the position shown in FIG. 8. As a result, the developing roller at the developing position is brought into contact with the drum 1 by the tension springs 170 and 171.

Preferably, a guide for guiding the revolver 117 into and out of the copier body should be provided, although not shown in the figures. Also, another pair of cams may be located below the cams 148 and 177 and operated by a motor which is a substitute for the operating lever 178.

Hereinafter will be described a specific operation for rotating the revolver 117 such that one of the developing sections 101Y–101Bk arrives at the developing position. As shown in FIGS. 3 and 7, a revolver drive motor 181 is affixed to one of the front and rear arms 161 and 160 (rear arm 160 in the embodiment). A worm 151 is mounted on the output shaft of the motor 181. A worm wheel 152 is rotatably and coaxially mounted on the support shaft 164 and held in mesh with the worm 151. An intermediate gear 180 is coaxially affixed to the worm wheel 152 and also rotatably mounted on the support shaft 164. The intermediate gear 180 is held in mesh with a gear 153 provided on the outer periphery of the rear end wall 102 of the revolver 117.

When the motor 181 is energized in response to a color change signal, the rotation of the motor 181 is transmitted to the gear 153 of the revolver 117 via the worm 151, worm wheel 152, and intermediate gear 180. As a result, the revolver 117 revolves until the expected developing section arrives at the developing position.

Figure 12:
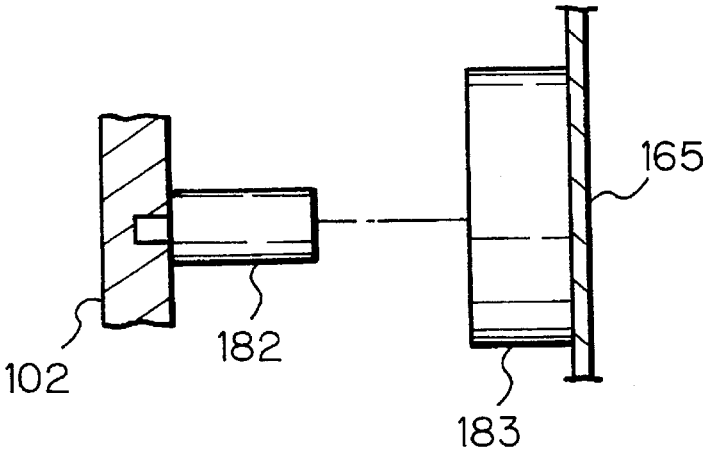
FIG. 12 shows a rear side wall with position sensor.

In the embodiment, the motor 181 is implemented by a stepping motor. As shown in FIGS. 3 and 7, a pin 182 is studded on the rear end wall 102 of the revolver 117. As shown in FIG. 12, a position sensor 183 is affixed to the rear side wall 165 of the copier body and implemented by a photosensor. In FIG. 7, the position sensor 183, like the rear side wall 165, is indicated by a phantom line. When the pin 182 faces the sensor 183, light issuing from the light source of the sensor 183 is reflected from the tip of the pin 182 and incident to the light-sensitive portion of the sensor 183. The resulting output of the sensor 183 indicates that the revolver 117 has reached a predetermined home position.

The motor 181 is rotated by a predetermined number of pulses in response to a color change signal received from a controller, not shown, As a result, the revolver 117 is related from the home position until the expected developing section arrives at the developing position. After the developing section has developed a latent image, the motor 181 is again rotated by a predetermined number of pulses to bring the next developing section of the revolver 117 to the developing position.

In the revolver drive means stated above, the rotation of the motor 181 is transmitted to the revolver 117 via the worm 151 and worm wheel 152. Hence, when one of the developing sections operates at the developing position, the motor 181 is prevented from rotating due to a change in the lead acting thereon. This successfully maintains the revolver 117 in an adequate position during development and ensures an image of superior quality. In addition, the worm 151 and worm wheel 152 allow a great speed reduction ratio to be set up which promotes the efficient use of the motor 181.

The developing sections 101Y–101Bk of the revolver 117 each includes at least one developing element which is rotated during development. In the illustrative embodiment, each of them includes the developing roller, developer supply roller, residual image removing roller, send-out screw, and send-in screw, as stated earlier. A specific means for driving such developing elements will be described hereinafter.

As shown in FIGS. 3 and 7, a developing section drive motor 185 is mounted on one of the front and rear arms 161 and 160 (rear arm 160 in the embodiment) for driving the above-mentioned five developing elements of each developing section. In FIG. 3, the motor 185 is indicated by a phantom line. A first toothed pulley 186 is mounted on the output shaft of the motor 185. A second toothed pulley 154 is rotatably mounted on the rear arm 160. A timing belt 188 is passed over the pulleys 186 and 154. An intermediate gear 189 is coaxially affixed to the second pulley 154 and held in mesh with another intermediate gear 190 rotatably mounted on the rear arm 160. A first sun gear 155 is rotatably mounted on the rear end of the shaft 112 of the revolver 117. A second sun gear 113 is coaxially affixed to the sun gear 155 and rotatably mounted on the shaft 112 (see FIGS. 4 and 13 also).

In the above construction, the rotation of the motor 185 is transmitted to the first sun gear 155 via the first toothed pulley 186, timing belt 188, second toothed pulley 154, and intermediate gears 189 and 190. As a result, the second sun gear 113 is rotated about the shaft 112 in a direction indicated by an arrow in FIGS. 7 and 13.

Figure 13:
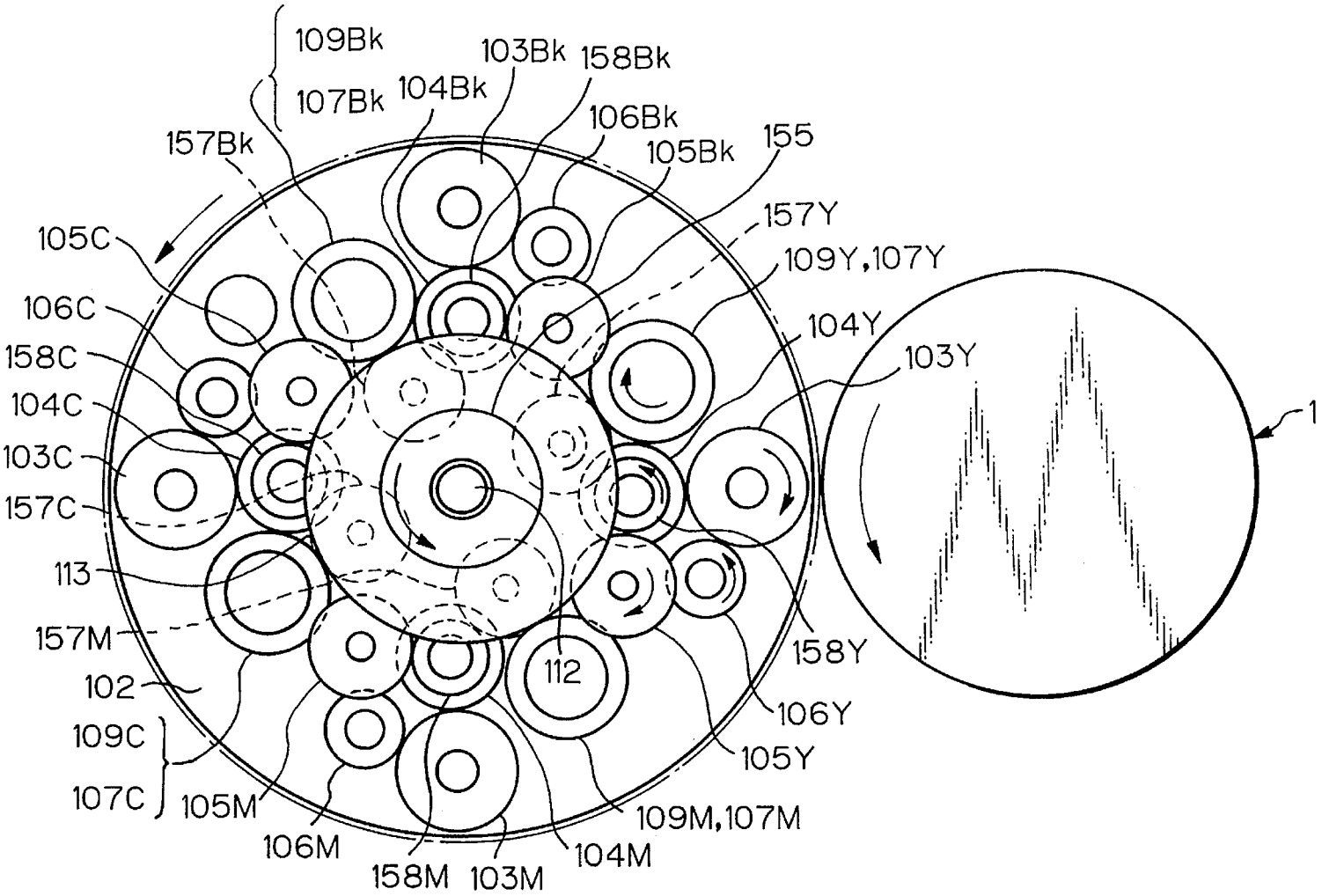
FIG. 13 shows the revolver as seen from the rear.
Figure 14:
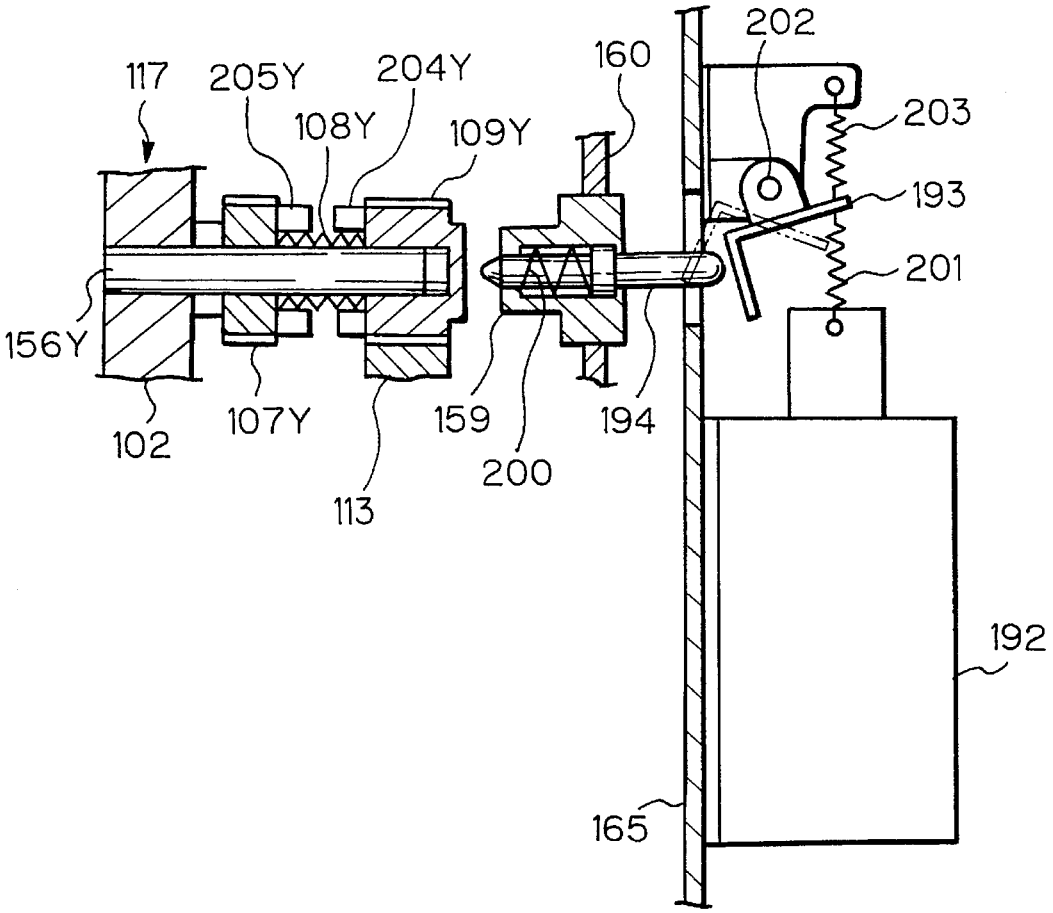
FIG. 14 is a section along line XIV—XIV of FIG. 7.

On the other hand, as shown in FIGS. 3, 13 and 14, gear trains each assigned to the respective developing section are mounted on the rear end wall 102 of the revolver 117 in addition to the sun gears 155 and 113. Let the following description concentrate on the gear train assigned to the yellow developing section 101Y by way of example. As shown in FIG. 14, a support pin 156Y is studded on the rear end wall 102 of the revolver 117. The gear train includes an intermediate gear 109Y meshing with the sun gear 113. The intermediate gear 109Y is mounted on the support pin 156Y in such a manner as to be rotatable about the pin 156Y and movable in the axial direction of the pin 156Y. Another intermediate gear 107Y is rotatably, but not axially movably, mounted on the support pin 156Y.

A gear 104Y is mounted on the rear end of thee shaft of the developer supply roller 130Y, FIG. 2. A gear 103Y is mounted on the rear end of the shaft of the developing roller 110Y. A gear 106Y is mounted on the rear end of the residual image removing roller 150Y. The previously mentioned intermediate gear 107Y is held in mesh with the gear 104Y which is, in turn, held in mesh with the gear 103Y. The gear 103Y is held in mesh with the gear 106Y. Gears 157Y and 105Y are respectively mounted on the rear ends of the screws 120 and 133. The gears 157Y and 105Y are each held in mesh with a gear 158Y which is coaxially affixed to the above-mentioned gear 104Y. These gears are arranged on the outer surface of the rear end wall 102.

When the sun gear 113 is rotated in the direction indicated by an arrow in FIG. 13, the rotation is transferred to the intermediate gear 107Y via the intermediate gear 109Y and a clutch or coupling mechanism which will be described. As a result, the gear 107Y is rotated in a direction also indicated by an arrow in FIG. 13. The rotation of the gear 107Y is transmitted to the gears 103Y and 105Y via the gear 104Y. The rotation of the gear 103Y is transferred to the gear 106Y. Further, the rotation of the gear 158Y, rotating integrally with the gear 104Y, is transferred to the gears 157Y and 105Y. Consequently, the gears 157Y and 105Y are each rotated in a direction indicated by an arrow in FIG. 13. Such a gear train causes each of the the supply roller 130Y, developing roller 110Y, residual image removing roller 150Y and screws 120 and 133 shown in FIG. 2 to rotate in a particular direction.

A gear train identical with the gear train stated above is associated with each of the other developing sections 101M, 101C and 101Bk and operated in the same manner. In FIG. 13, the suffix "Y" is replaced with a suffix "M" for the magenta developing section 101M, a suffix "C" for the cyan developing section 101C, and a suffix "Bk" for the developing section 101Bk.

As shown in FIGS. 3 and 7, all of the intermediate gears 190 and 189, toothed pulleys 154 and 186 and timing belt 188 for driving the sun gear 155 are mounted on one arm 160 and arranged along a line connecting the shafts 112 and 164. When part of the gearing between the motor 185 and the developing elements is arranged on the common arm 160, as described above, there can be obviated vibration attributable to the interference of gears and the offset of axes, and decrease in transmission efficiency.

An arrangement may be made such that all the developing elements of the developing sections 101Y–101Bk are rotated by the motor 185 at the same time. This, however, results in energy losses because only one developing section operates at a time. In the illustrative embodiment, the rotation of the motor 185 is transmitted only to the developing elements of the developing section which is operating at the developing position, as follows.

FIG. 13, like FIG. 2, shows a specific condition wherein the yellow developing section 101Y is located at the developing position. On the other hand, as shown in FIG. 14, a control pin 194 is mounted on the portion of the rear arm 160 facing the intermediate gear 109Y. The control pin 194 can protrude from the arm 160 in the axial direction. Specifically, the control pin 194 is held by a holder 159 affixed to the arm 160. A compression spring 200 usually maintains the control pin 194 in the position shown in FIG. 14. A solenoid 192 (not shown in FIG. 7) is affixed to the outer surface of the rear side wall 165. An operating piece 193 is connected to the plunger of the solenoid 192 by a tension spring 201. The operating piece 193 is connected to the rear side wall 165 by a pivot pin 202. Another tension spring 203 is positioned at the opposite side to the tension spring 201 and anchored to the piece 193 at one end thereof. The other end of the tension spring 203 is anchored to the rear side wall 165. Pawls 204Y and 205Y are respectively provided on the facing surfaces of the intermediate gears 109Y and 107Y and engageable with each other. A compression spring 108Y is loaded between the gears 109Y and 107Y. This is also true with the two intermediate gears assigned to each of the other developing sections 101M, 101C and 101Bk.

Before the yellow developing section 101Y operates, the solenoid 192 remains deenergized. Hence, the control pin 194 is held in the retracted position shown in FIG. 14. The intermediate gears 109Y and 107Y of the revolver 117 and, therefore, the pawls 204Y and 205Y are spaced apart from each other by the compression spring 108Y. In this condition, although the intermediate gear 109Y may be rotated by the sun gear 113, the rotation of the gear 109Y is not transferred to the intermediate gear 107Y. This prevents the developing elements, including the developing roller 110Y, of the yellow developing section 101Y from rotating.

Assume that the yellow developing unit 101Y is brought to the developing position, as shown in FIG. 13, and the controller generates a development start command. Then, the solenoid 192 is energized to pull the plunger thereof. The plunger rotates the operating piece 193 clockwise, as viewed in FIG. 14, thereby pushing the control pin 194 to the front (to the left in FIG. 14). As a result, the control pin 194 protrudes to the front against the action of the spring 200 and pushes the intermediate gear 109Y. The gear 109Y slides to the front by being guided by the support pin 156Y, until the pawl 204Y thereof mates with the pawl 205Y of the other intermediate gear 107Y. Consequently, the rotation of the gear 109Y is transferred to the gear 107Y so as to drive the developing elements of the developing section 101Y. In the other developing sections 101M, 101C and 101Bk, the intermediate gears 109M, 109C and 109Bk are spaced apart from the intermediate gears 107M, 107C and 107Bk, respectively. Hence, the developing elements of these developing sections do not rotate.

When the yellow developing section 101Y ends development, the solenoid 192 is deenergized to restore the operating piece 193 to the solid-line position of FIG. 14 due to the action of the spring 203. The control pin 194 is also returned to the position shown in FIG. 14. As a result, the intermediate gear 109Y slides to the rear (to the right in FIG. 14) due to the action of the compression spring 108Y, so that the pawls 204Y and 205Y are released from each other. Consequently, the developing elements of the developing section 101Y stop rotating.

When the other developing units 101M, 101C and 101Bk are each brought to the developing position, their intermediate gears 109M, 109C and 109Bk are also brought into mesh with the counterparts 107M, 107C and 107Bk, respectively.

As stated above, the embodiment drives only the developing elements of one developing section which is brought to the developing position for operation. This not only saves energy but also reduces the vibration of the revolver 117 and enhances image quality, compared to the case wherein all the developing elements of the revolver 117 are driven at the same time. Moreover, the toner is free from excessive mechanical hazard and, therefore, durable. In addition, the durability of the developing elements, including the developing rollers, and the gearing for driving them is enhanced, The pawls 204Y and 205Y and compression spring 108Y shown in FIG. 14 constitute a clutch mechanism, or coupling mechanism, for determining whether or not to transfer the rotation of the motor 185 to the developing elements of the developing section. However, such a clutch mechanism is only illustrative. The clutch mechanism or coupling mechanism, combined with the solenoid 192, operating piece 193, control pin 194 and springs 200, 201 and 203, constitutes a specific means for selectively transmitting the rotation of the motor 185 only to the developing elements of the developing section brought to the developing position.

Because the control pin 194 is mounted on the arm 160, it is possible to maintain the first intermediate gear of each developing section and the control pin 194 in the preselected relation accurately. In addition, because the solenoid 192 and operating piece 193 for operating the control pin 194 are mounted on the rear side wall 165 of the copier body, changes in lead and mechanical vibration due to the operation of the solenoid 192 are sparingly transferred to the revolver 117. This increases the drive transmission efficiency and enhances image quality.

When the motor 185 shown in FIG. 3 is mounted on the portion of the arm 160 below the shaft 164, preferably immediately below and in close proximity to it, the moment acting on the arm 160 due to the weight of the motor 185 will influence the arm 160 little. Hence, the arm 160 can pivot stably. This is also true with the revolver drive motor 181.

Figure 4:
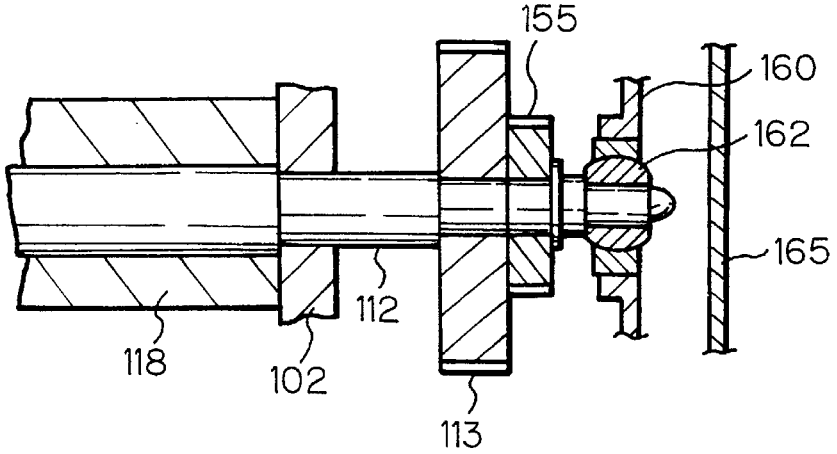
FIG. 4 is a section along line IV—IV of FIG. 7.

The revolver 117 is removably mounted on the arms 160 and 161, as stated earlier. To dismount the revolver 117, the rear end of the shaft 112 is pulled out from the bearing 162 mounted on the rear arm 160, as shown in FIG. 4. To mount the revolver 117, the rear end of the shaft 112 is coupled to the bearing 162. In the illustrative embodiment, the bearing 162 is implemented as an automatic aligning bearing. When the revolver 177 is inserted into the copier body, the rear end of the shaft 112 is coupled to the bearing 162. Subsequently, the sun gear 155 meshes with the intermediate gear 190 supported by the arm 160, as shown in FIG. 7. At this instant, the automatic aligning bearing 162 allows the shaft 112 to incline about the bearing 162, so that the gears 155 and 190 can mesh automatically.

The bearings 162 and 163 of both of the arms 160 and 161 may be implemented by automatic aligning bearings, if desired. Then, the developing roller can be uniformly pressed against the drum 1 with accuracy even though the revolver 117 and drum 1 may not be precisely parallel to each other. Further, an arrangement may be made such that the intermediate gear 190 mounted on the arm 160 is movable in the axial direction and constantly biased away from the arm 160, i.e., to the front by a compression spring, not shown. Such an arrangement allows the gears 155 and 190 to mesh automatically due to the rotation of the gear 190. Moreover, even when the gears 155 and 190 abut against each other during the insertion of the revolver 117, the above-mentioned compression spring absorbs the resulting impact and thereby protects the gears 155 and 190 from damage.

Bias voltages should be applied to preselected developing elements included in each developing section. The embodiment applies a particular voltage to each of the developing roller, developer supply roller, and residual image removing roller. As shown in FIGS. 3, 6 and 8, terminal pins 125Y, 125M, 125C and 125Bk are affixed to the front end wall of the revolver 117. The terminals pins 125Y–125Bk each has terminals, not shown, connected to the three developing elements of the respective developing section. Alternatively, the terminal pins 125Y–125Bk may be provided on a circuit board 134A, FIG. 6, included in the toner container 134.

Figure 15:
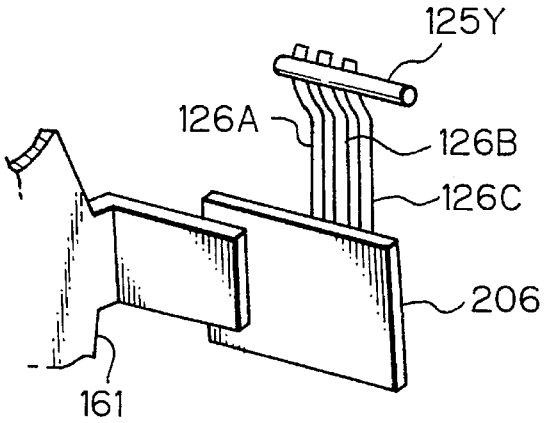
FIG. 15 is a perspective view showing contact members supported by a front pivotable arm, and a terminal pin engageable with the contact members.

As shown in FIGS. 8 and 15, three contact members 126A, 126B and 126C are affixed to the front arm 161 with the intermediary of an insulator 206. When one of the developing sections is brought to the developing position, the terminal pin 125Y, 125M, 125Bk or 125C thereof contacts the contact members 126A–126C. FIGS. 8 and 15 show a specific condition wherein the yellow developing section 101Y is located at the developing position with the terminal pin 125Y contacting the contact members 126A–126C. Specifically, the three terminals of the terminal pin 125Y connected to the developing roller 110Y, developer supply roller 130Y and residual image removing roller 150Y, respectively, contact the terminals 126A, 126B and 126C, respectively.

In the above configuration, a particular voltage is applied from a bias power source to each of the contact members 126A–126C. As a result, an adequate bias voltage is applied to each of the developing roller 110Y, developer supply roller 130Y, and residual image removing roller 150Y. When any one of the other developing sections is brought to the developing position, the terminals of the terminal pin 125M, 125C or 125Bk are also caused to contact the terminal members 126A–126C.

Figure 16:
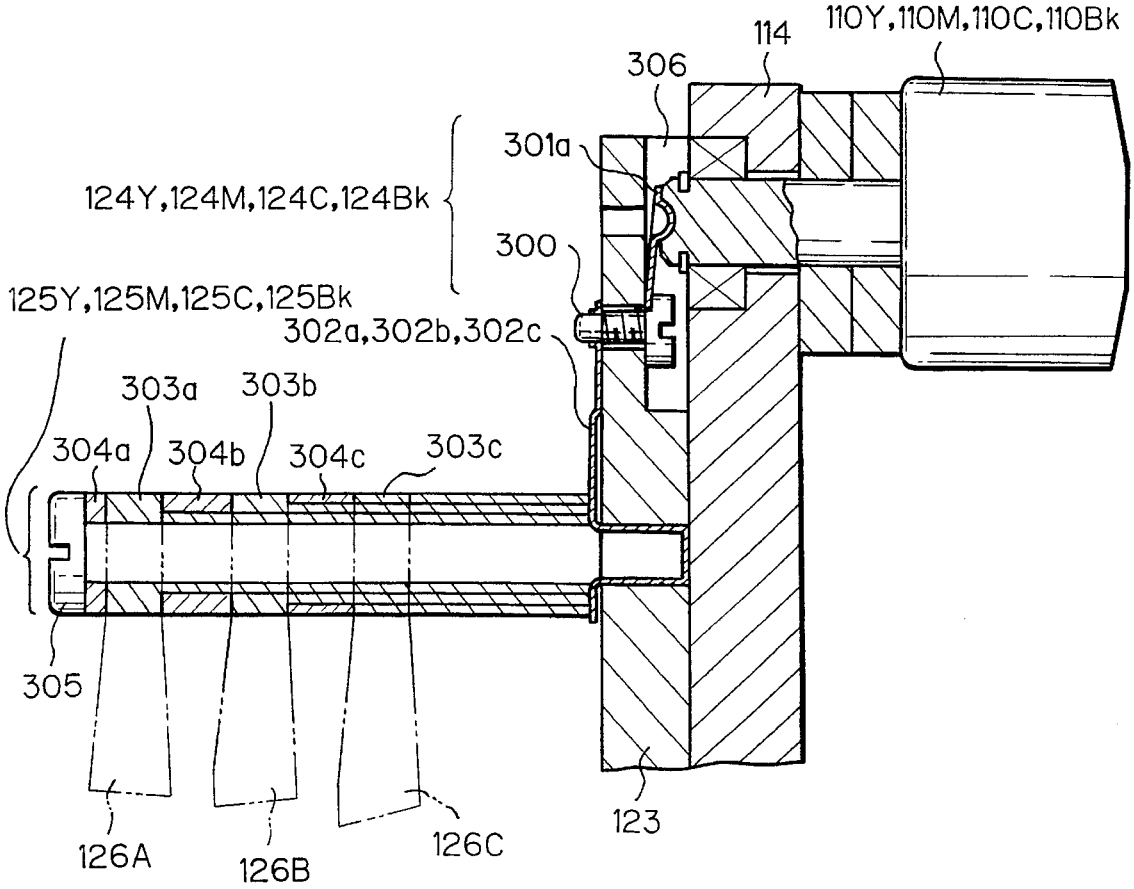
FIG. 16 shows a path for feeding a bias voltage to a developing element.

The terminal pins 125Y–125Bk and contact members 126A–126C will be described more specifically. As shown in FIG. 16, the terminal pins 125Y–125Bk are each implemented as a fixed pin 305 and studded on a plate 123 via an insulator 206. The plate 123 is mounted on the outer surface of the front end wall 114 of the revolver 117. The portions of the plate 123 aligned with the shafts of the developing rollers 110Y–110Bk are thinner than the other portion to form gaps 306. The shafts of the developing rollers 110Y–110Bk each has the cad thereof received in one of the gaps 306. A contact piece 301*a* is fastened to the plate 123 by a screw 300 at one end thereof and implemented by a leaf spring. The other or free end of the contact piece 301*a* is pressed against the recessed end of associated one of the shafts of the rollers 110Y–110Bk. In FIG. 16, the reference numeral 302*a* designates a feed member. The contact piece 301*a* and feed member 302*a* are collectively represented by the bias terminal 124Y. This is also true with the other contact pieces 301*b* and 301*c* and feed members 302*b* and 302*c*. The screw 300, extending throughout the plate 123, retains one end of the flat feed member 302*a* on the outer surface of the plate 123. The other end of the feed member 302*a* is fixed in place by the cads of three feed pin terminals 303*a*, 303*b* and 303*c* in which a fixing pin 305 is inserted.

Figure 17:
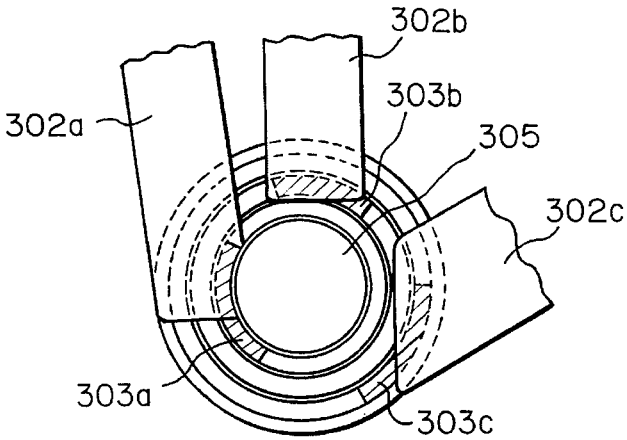
FIG. 17 shows bow feed members and feed pin terminals are electrically connected.

Specifically, the feed pin terminals 303*a*–303*c* are each implemented as a hollow cylindrical conductor. The terminal 303*b* is received in the terminal 303*c* while the terminal 303*a* is received in the terminal 303*b*. The fixing pin 305 has the shank thereof received in the terminal 303*a*. Insulating collars 304*c*, 304*b* and 304*a* respectively intervene between the terminals 303*c* and 303*b*, between the terminals 303*b* and 303*a*, and between the terminal 303*a* and the fixing pin 305. When the pin 305 is driven into the plate 123, the end of the terminal 303*a* press the end of the feed member 302*a*, as also shown in FIG. 17. Likewise, the ends of the feed members 302*b* and 302*c* are respectively pressed by the ends of the terminals 303*b* and 303*c*. When the revolver 117 is rotated, the contact members 126A, 126B and 126C of each developing section contact the feed pin terminals 303*a*, 303*b* and 303*c*, respectively.

Figure 18:
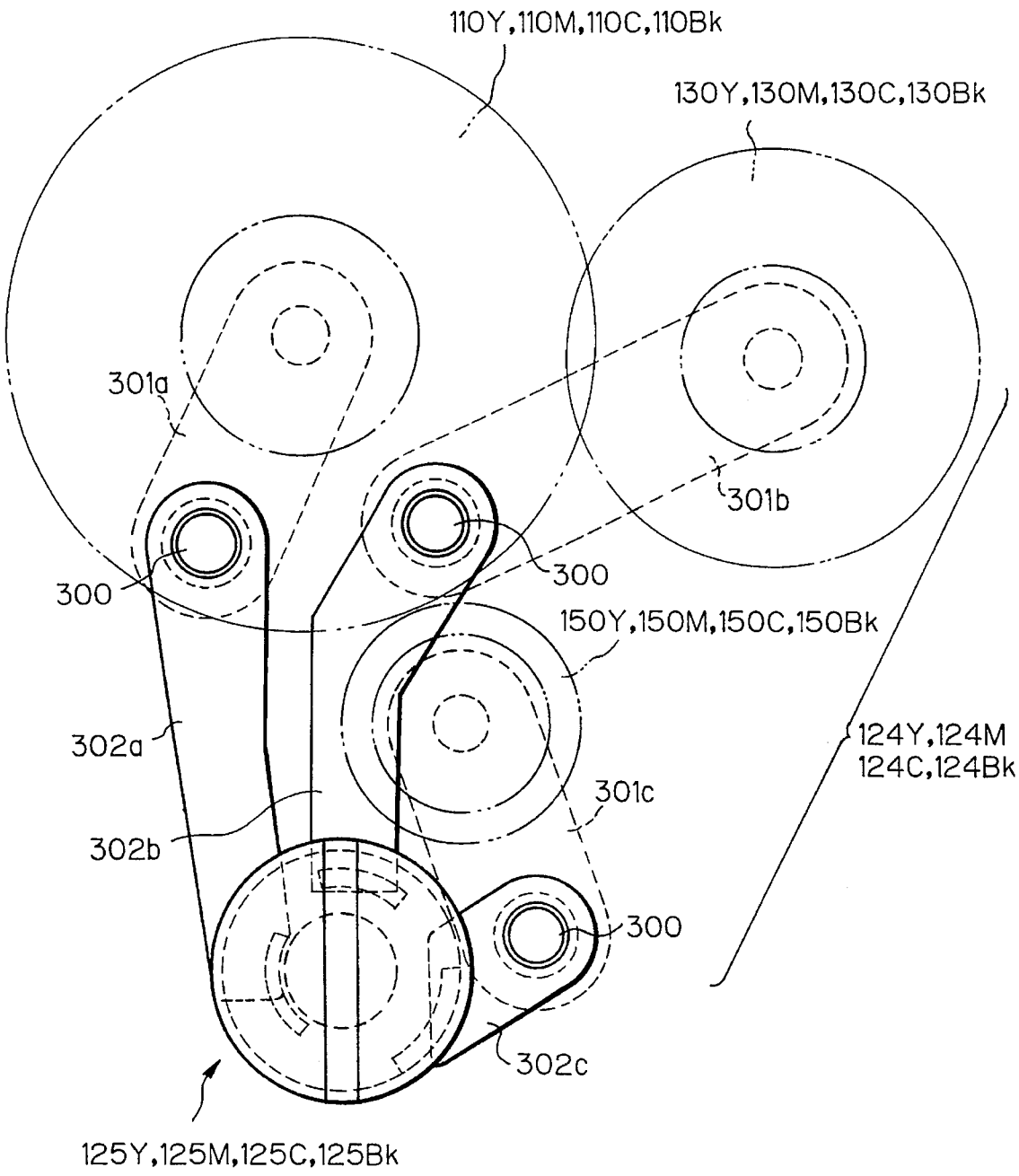
FIG. 18 is a fragmentary view of portions for applying bias voltages.

As shown in FIG. 18, the bias terminals 124Y–124Bk each consists of the contact members 301*a*–301*c* which respectively feed bias voltages to the developing roller 110, developer supply roller 130, and residual image removing roller 150 in contact therewith, and feed members 302*a*–302*c* for feeding voltages to the contact members 301*a*–301*c*. The contact members 301*a*–301*c* and feed members 302*a*–302*c* are affixed to and electrically connected to the plate 123 by the screws 300. The members constituting the electrical paths between the feed pin terminals 303*a*–303*c* and the contact members 301*a*–301*c* are insulated except for their contacting portions. In this configuration, bias voltages are applied from a power source, not shown, to the contact members 126A–126C and therefrom to the rollers 110Y–110BK, 130Y–130Bk, and 150Y–150Bk via the respective feed paths.

As stated above, the contact members 126A–126C are mounted on the arm 161. When one of the developing sections of the revolver 117 is brought to the developing position, the terminal pin 125Y, 125M, 125C or 125Bk of the developing section contacts the contact members 126A–126C. Hence, the terminal pin and contact members are allowed to contact each other in a predetermined relation at all times, so that bias voltages can be stably applied to the respective developing elements. Further, because bias voltages are applied only to the developing elements of the developing section located at the developing position, not only power consumption is reduced, but also electromagnetic noise is obviated to reduce the hazard to the toner. As a result, the image quality, the reliability of the developing devise and the durability of the toner are enhanced. In addition, the conduction paths for applying bias voltages are implemented by conductors and screws in place of solder or the like. Therefore, the path arrangement is simple and sure and promotes easy production and easy maintenance.

In the embodiment, the rotation of the motor 185 is transmitted to the developing elements of each developing section by the gearing including the toothed pulleys 186 and 154 and timing belt 188, as shown in FIGS. 3 and 7. Alternative drive transmission arrangements will be described hereinafter.

Figure 19:
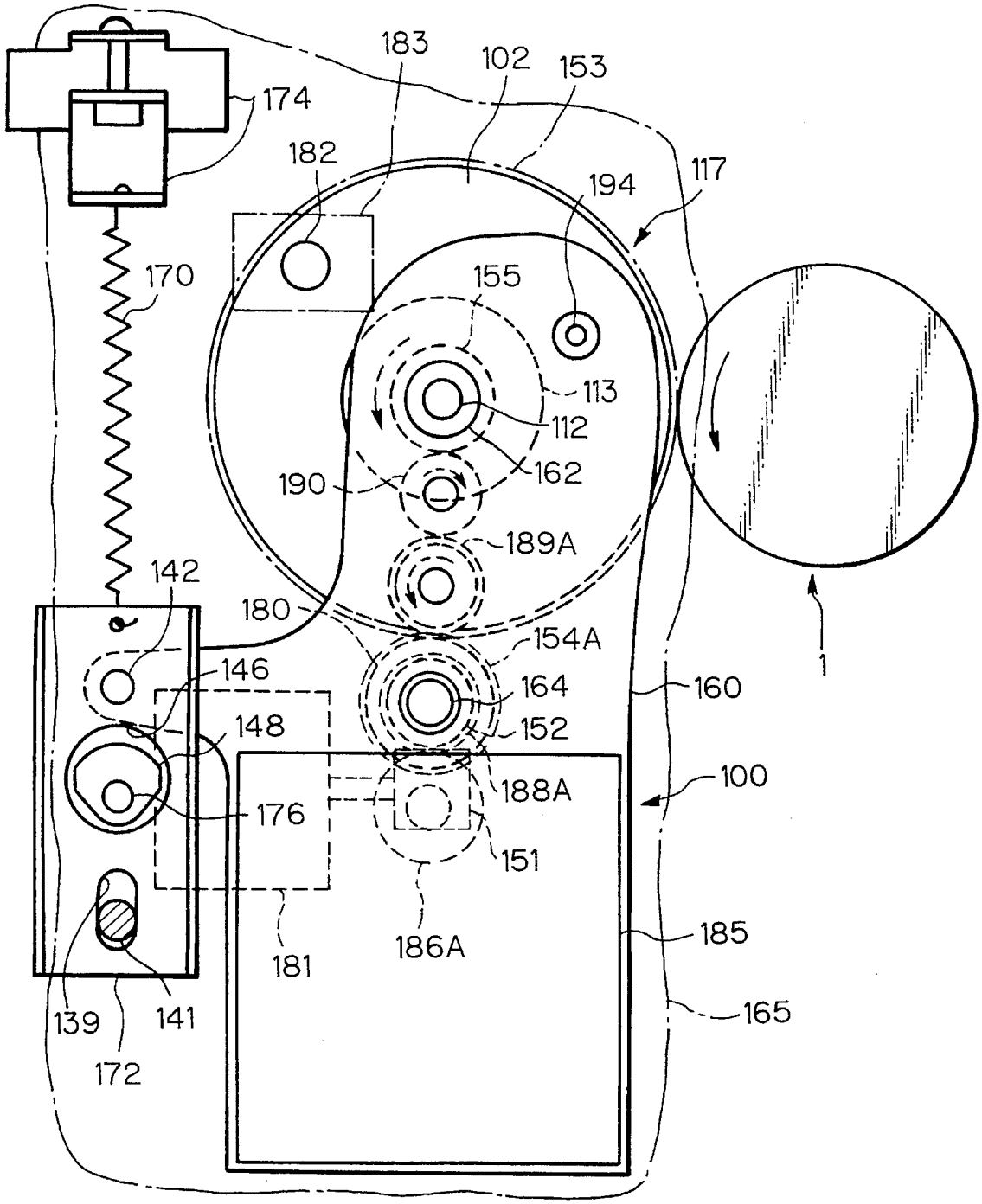
FIGS. 19 and 20 each shows a modification of the developing device of FIG, 7.

Referring to FIG. 19, a gear 186A is mounted on the output shaft of the motor 185 which is affixed to the rear arm 160. An intermediate gear 188A is rotatably mounted on the support shaft 164 and held in mesh with the gear 186A. Another intermediate gear 154A is coaxially affixed to the gear 188A and rotatably mounted on the shaft 164. The gear 154A is held in mesh with still another intermediate gear 189A which is rotatably mounted on the arm 160. The gear 189A is held in mesh with the intermediate gear 190. FIG. 7, rotatably mounted on the arm 160. The rest of the construction is essentially identical with the construction of FIGS. 1–15. In operation, the rotation of the motor 185 is transmitted to the gear 190 via the gears 186A, 188A, 154A and 189A. The gear 190 drives the sun gear 155 with the result that the developing elements of the developing section brought to the developing station are driven in the previously stated manner.

In the modification of FIG. 19, the motor 185 is also positioned immediately below and in close proximity to the support shaft 164. Again, the gears 186A, 188A, 154A, 189A, 190 and 155 are arranged on the line connecting the shafts 112 and 164. Because the drive transmission members 190, 189A, 154A, 188A and 186A are mounted on one arm 160, there can be obviated vibration attributable to the interference of the gears and the offset of axes, and decrease in transmission efficiency.

Figure 20:
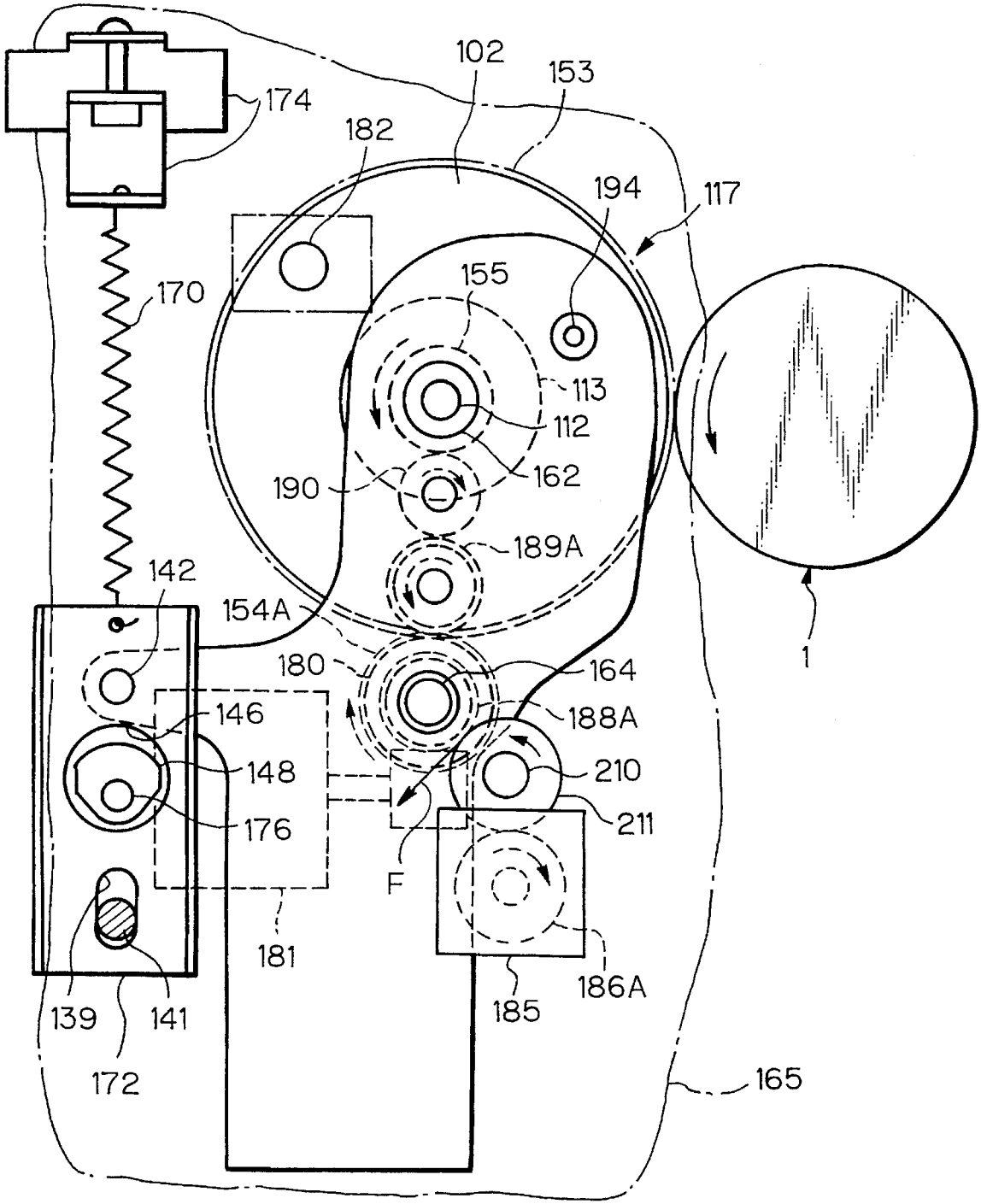
Figure 21:
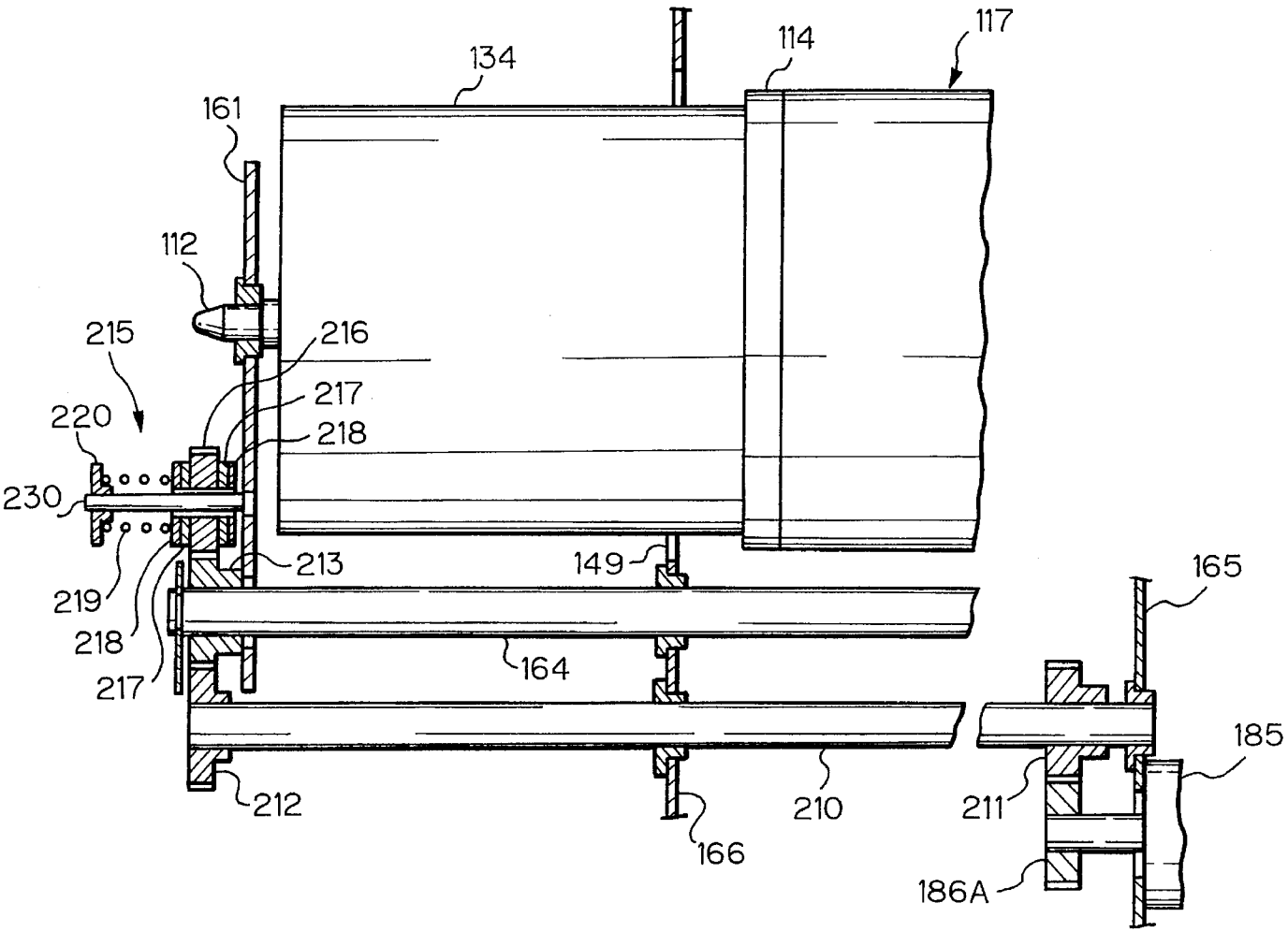
FIG. 21 is a fragmentary section of the modification of FIG. 20 as viewed from the left.

In the embodiment of FIG. 7 and the modification of FIG. 19, the motor 185 is affixed to the arm 160. Alternatively, as shown in FIGS. 20 and 21, the motor 185 may be affixed to the copier body. Specifically, as shown in FIG. 21, the motor 185 is affixed to the rear side wall 165 of the copier body. The gear 186A, mounted on the output shaft of the motor 185, is held in mesh with a gear 211 rotatably mounted on the copier body. The gear 211 is held in mesh with the gear 188A which is rotatably mounted on the support shaft 164. As shown in FIGS. 20 and 21, the gear 211 is mounted on a rotary shaft 210 which is journalled to the front and rear side walls 166 and 165 of the copier body. In operation, the rotation of the motor 185 is transmitted to the gear 188A via the gears 186A and 211. This is followed by the drive transmission described with reference to FIG. 19.

In FIGS. 20 and 21, the gear 188A driven by the gear 211, which is mounted on the copier body, is rotatably mounted on the shaft 164 about which the arm 160 is pivotable. Hence, despite that the arm 160 pivots, the gears 211 and 188A are held in mesh with each other so as to transfer the rotation accurately. Again, there can be obviated vibration attributable to the interference of the gears and the offset of axes, and decrease in transmission efficiency.

The developing devices shown in FIGS. 7, 19 and 20 each has the motor 185 for driving at least one (five in this case) developing element of each developing section, and a plurality of drive transmission elements for transmitting the rotation of the motor 185 to the developing elements. In any case, the rotation of the motor 185 is transferred from one axial end, i.e., the rear end of the revolver 117. Specifically, the rotation of the drive transmission elements mounted on the rear arm 160 is transmitted to the developing elements of the developing section via a plurality of gears mounted on the outer surface of the rear end wall 102.

In the modification shown in FIG. 20, the motor 185 is mounted on the copier body while the drive transmission elements 188A, 154A, 189A, 190, 155 and 113 are mounted on the arm 160. The gears 188A and 154A are rotatably mounted on the shaft 164, but the arm 160 itself is pivotable about the shaft 164. In this sense, the gears 188A and 154A may be regarded as being rotatably mounted on the arm 160 The gears to be driven by such a group of gears are rotatably mounted on the revolver 117, as stated earlier with reference to FIG. 13. Thus, the device shown in FIG. 20 has a plurality of drive transmission elements mounted on the arm 160 and revolver 117 for transmitting the rotation of the motor 185 to the developing section from one axial end of the revolver 117.

In FIG. 20, when the rotation of the motor 185 is transferred to the gear 188A mounted on the arm 160 via the gear 211, a force acts on the gear 188A in a direction F which is deviated from a common line tangential to the pitch circles of the gears 211 and 188A by the pressure angle of the gear. Let this force F be referred to as a tangential force. The tangential force F acts on the arm 160 as a moment around the axis of rotation, i.e., the axis of the support shaft 164. Assume that no measures are taken against such a moment. Then, a moment acts on the arm 160 in such a direction that the end of the arm 160 and, therefore, the developing roller of the developing section located at the developing position approaches the drum 1. On the other hand, no drive transmission to the revolver 117 occurs at the other arm 161. As a result, the developing roller contacting the drum 1 tends to approach the drum 1 only at the rear end portion thereof. Such a difference in pressure between the front and rear ends of the developing roller directly translates into a difference in density between the front and rear ends of a toner image formed on the drum 1.

Further, in the device shown in FIG. 20, assume that the number of gears constituting the gear train is changed to rotate the gear 211 in the opposite direction to the direction shown in the figure. Then, the tangential force F is reversed in direction with the result that the rear portion of the developing roller contacts the drum 1 with a smaller force than the front portion of the same. This also invites an irregular density distribution.

As described above, when a drive force is transferred from the copier body to the drive transmission elements mounted only on one arm 160, it is likely that the developing roller at the developing position fails to contact the drum 1 with a uniform pressure. A measure against such an occurrence will be described later.

In contrast, in FIG. 7, the motor 185 is mounted on one arm 160. In addition, all the drive transmission elements for transmitting the rotation of the motor 185 to the developing elements from one axial end of the revolver 117 are mounted on the arm 160 and revolver 117. In this configuration, a moment tending to move the arm 160 toward or away from the drum 1 does not act on the arm 160. Specifically, although the rotation is transmitted to the developing elements from one end of the revolver 117 via one arm 160, the drive force is not transmitted from the outside of the arm 160, i.e., from the copier body. This prevents the above-mentioned moment from acting on the arm 160. Hence, the developing roller is allowed to contact the drum 1 with a uniform pressure over the entire length thereof, ensuring a desirable toner image free from irregular density on the drum 1. This is also true with the modification shown in FIG. 19; the motor 185 is mounted on one arm 160 while all the drive transmission elements are mounted on the arm 160 and revolver 177.

The measure included in the modification of FIG. 20 against the irregular contact of the developing roller with the drum 1 will be described specifically. The rotary shaft 210 supporting the gear 211 is journalled to the opposite side walls 165 and 166 of the copier body and is parallel to the revolver 117. As shown in FIG. 21, another gear 212 is mounted on the front end of the rotary shaft 210. A rotary member in the form of an intermediate gear 213 is rotatably and coaxially mounted on the support shaft 164. The gear 213 is held in mesh with the gear 212. The front arm 161 is provided with a brake mechanism 215.

The brake mechanism 215 includes a support pin 230 studded on the front surface of the arm 161. A friction gear 216 is rotatably mounted on the support pin 230. A pair of friction members 217 are mounted on the support pin 230 and abutted against the opposite sides of the friction gear 216. A pair of retainer plates 218 retain the friction members 217 at opposite sides. A spring seat 220 is affixed to the tip of the support pin 230. A compression spring 219 is loaded between the spring seat 220 and one of the retainer plates 218. While the gear 216, friction member 217 and retainer plates 218 are slidable on and along the support pin 230, they are prevented from moving to the rest (to the right) beyond the position shown in FIG. 21 by a stop, not shown. The friction gear 216 is held in mesh with the gear 213 which is rotatable on the support shaft 164.

When the motor 185 shown in FIGS. 20 and 21 is rotated, the rotation is transmitted to the friction gear 216 via the gears 186A and 211, shaft 210, and gears 212 and 213. Because the friction members 217 are pressed against the gear 216 by the spring 219, a braking force acts on the gear 216 and prevents it from freely rotating. As a result, a predetermined lead, i.e., braking force acts also on the gear 213 meshing with the gear 216. The brake mechanism 215 is constructed such that the braking force acting on the gear 213 is substantially equal to a load, or braking force, being exerted by the gear 189A on the rear gear 154A which is coaxial with the gear 213.

A moment acts on the rear arm 160 due to the tangential force F, as stated earlier. However, the arrangement described above causes a moment of substantially the same size and acting in the same direction as the moment acting on the rear arm 160 to act on the front arm 161. Specifically, a moment tending to cause the arm 161 to approach the drum 1 is exerted by the gear 213, rotatable about the shaft 164, via the brake mechanism 215. Because the brake mechanism 215 exerts a particular braking force as stated above, moments of the same size act on the arms 160 and 161 in the same direction. Hence, the developing roller is pressed against the drum 1 by a uniform pressure over the entire length thereof, ensuring a toner image of desirable quality on the drum 1. When a tangential force acts on the rear arm 160 in the opposite direction to the tangential force shown in FIG. 20, the developing roller is also uniformly pressed against the drum 1.

As described above, the modification of FIG. 20 includes a moment applying means for applying, when the rotation of the motor 185 is transmitted to the gear or drive transmission element 188A, a moment of substantially the same size as a moment acting on the arm 160 to the other arm 161 in the same direction. The moment applying means is implemented by the gear or rotary body 213 rotatably and coaxially mounted on the shaft 164, which supports the arm 161, and brake mechanism 215 mounted on the other arm 161 for exerting a braking force on the gear 213.

In summary, it will be seen that the present invention has various unprecedented advantages as enumerated below.

(1) A rotary developing unit or revolver is movable toward and away from an image carrier and constantly biased toward the image carrier. Therefore, a developer carrier brought to a developing position can be located at an adequate position relative to the image carrier, ensuring a desirable multicolor image.

(2) Because the revolver is pressed at axially opposite ends thereof, the developer carrier brought to the developing position can be positioned more accurately relative to the image carrier, further enhancing image quality.

(3) Despite that developing elements are driven by a force transmitted from one of two pivotable bodies, the image carrier can be accurately positioned relative to the image carrier.

(4) A moment applying means is simple in configuration and sure in operation.

(5) Energy consumption is reduced. Loads on the developing elements of each developing section and the developer are reduced to extend their lifes.

Various modifications will become possible for those skilled in the art after receiving the teachings of the present disclosure without departing from the scope thereof. For example, the present invention is applicable not only to a color copier but also to a color printer, color facsimile apparatus or similar image forming apparatus of the type having a rotary developing device which stores at least toner of two different colors. The present invention is practicable even when the image carrier is implemented as a photoconductive belt, dielectric belt, or dielectric drum.

What is claimed is:

1. A rotary developing device for an image forming apparatus and for developing a latent image electrostatically formed on an image carrier, said device comprising:

a revolver having at least two developing sections each storing a developer of particular color, and each having a developer carrier for conveying said developer deposited thereon; and a revolver drive means for rotating said revolver such that one of said developing sections is brought to a developing position facing the image carrier at a time;

said revolver comprising:

a pivotable support means pivotable about a fulcrum and having a first portion, extending away from the fulcrum, said first portion supporting said revolver such that said revolver is movable toward or away from the image carrier; and a biasing means applying a constant biasing force to a second portion of the pivotable support means, said second portion extending in a different direction from the fulcrum than the first portion, such that points where the revolver is supported and the biasing force is applied are on different sides of the fulcrum for constantly biasing said revolver toward the image carrier.

2. A device as claimed in claim 1, wherein said pivotable support means comprises a pair of pivotable bodies pivotably supported by a body of said image forming apparatus, and each supporting one of axially opposite ends of said revolver.

3. A device as claimed in claim 2, further comprising:

a motor for rotating at least one developing element included in each of said developing sections; and a plurality of drive transmission elements for transmitting a rotation of said motor to said developing element from one of the axially opposite ends of said revolver;

said motor being mounted on one of said pair of pivotable bodies, all of said drive transmission elements being mounted on said one pivotable body and said revolver.

4. A device as claimed in claim 3, further comprising a control means for controlling transmission of the rotation of said motor such that the rotation of said motor is transmitted only to the developing element of one of said developing sections brought to the developing position.

5. A device as claimed in claim 2, further comprising:

a motor for rotating at least one developing element included in each of said developing sections and mounted on said body of said image forming element;

a plurality of drive transmission elements mounted on one of said pair of pivotable bodies for transmitting a rotation of said motor to said at least one developing element from one of the axially opposite ends of said revolver; and moment applying means for applying, when the rotation of said motor is transmitted to one of said drive transmission elements mounted on one pivotable body, a moment of substantially a same size as a moment acting on said one pivotable body to another pivotable body in a same direction.

6. A device as claimed in claim 5, wherein said moment applying means comprises:

a rotary body rotatably mounted on a support shaft pivotably supporting said other pivotable body, and rotated by said motor; and a brake means arranged on said other pivotable body and for exerting a braking force on said rotary body.

7. A device as claimed in claim 2, wherein the fulcrum comprises:

a rotatable shaft connected to each of the pivotable bodies at axially opposite ends, wherein said pivotable bodies are integrally formed such that a difference in force applied between the pivotable bodies by the biasing means is translated between the pivotable bodies and the revolver is biased toward the image carrier with uniform force at each of said axially opposite ends.

8. A device as claimed in claim 1, further comprising:

a bias applying means constructed integrally with said revolver and for applying a particular bias voltage to each of a plurality of developing elements of one of said developing sections selected; and a bias voltage applying member mounted on said pivotable support means and for applying a bias voltage from a power source to said bias voltage applying means in contact therewith.

9. A device as claimed in claim 8, wherein said bias voltage applying member comprises a plurality of contact members affixed to said pivotable support means at one end and applies the bias voltage when the other ends of said plurality of contact members contact said voltage applying means, said other ends of said plurality of contact members contacting, when said revolver is rotated, said bias voltage applying means.

* * * * *